US008807960B2

(12) United States Patent
Stephenson et al.

(10) Patent No.: US 8,807,960 B2
(45) Date of Patent: Aug. 19, 2014

(54) SYSTEM AND METHOD FOR SERVICING A WELLBORE

(75) Inventors: Stanley V. Stephenson, Duncan, OK (US); David M. Stribling, Duncan, OK (US); Chad Heitman, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 1245 days.

(21) Appl. No.: 12/481,508

(22) Filed: Jun. 9, 2009

(65) Prior Publication Data

US 2010/0310384 A1 Dec. 9, 2010

(51) Int. Cl.

| | |
|---|---|
| ***F04B 47/00*** | (2006.01) |
| ***F04B 49/10*** | (2006.01) |
| ***F04B 23/06*** | (2006.01) |

(52) U.S. Cl.

CPC ..... *F04B 47/00* (2013.01); *F04B 49/106* (2013.01); *F04B 23/06* (2013.01)

USPC ..... 417/216; 417/53; 417/62; 166/68; 166/105

(58) Field of Classification Search

CPC ..... F04B 47/00; F04B 49/106; F04B 23/06

USPC ..... 166/68, 105, 308.1, 177.5; 417/53, 62, 417/216; 702/33–35, 45

See application file for complete search history.

(56) References Cited

U.S. PATENT DOCUMENTS

| | | | |
|---|---|---|---|
| 6,742,441 | B1 | 6/2004 | Surjaatmadja et al. |
| 7,409,901 | B2 | 8/2008 | Lucas et al. |
| 7,563,076 | B2 | 7/2009 | Brunet et al. |

*Primary Examiner* — Yong-Suk (Philip) Ro

(74) *Attorney, Agent, or Firm* — John Wustenberg; Conley Rose, P.C.

(57) ABSTRACT

A method of servicing a wellbore, comprising establishing a pumping profile having a performance plan, operating a first pump according to a first pumping parameter value, and operating a second pump according to the second pumping parameter value, wherein the second pumping parameter value is selected relative to the first pumping parameter value to improve a conformance of a phase sensitive combined pump effect operational characteristic to the performance plan. A wellbore servicing system, comprising a pump group comprising a plurality of plungers wherein at least some of the plurality of plungers are substantially configured according to an equal phase angle distribution arrangement.

30 Claims, 13 Drawing Sheets

SYSTEM AND METHOD FOR SERVICING A WELLBORE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

Embodiments described herein relate to wellbore servicing equipment and methods of servicing a wellbore.

BACKGROUND

Servicing a wellbore may include delivering a wellbore servicing fluid downhole and/or into a wellbore. A plurality of pumps may be used to deliver wellbore servicing fluid at a predetermined combined fluid flowrate and/or pressure. However, the very combination of the output of the plurality of pumps sometimes interferes with the ability of the plurality of pumps to precisely and/or accurately deliver the wellbore servicing fluids at a desired combined flowrate, pressure, or other characteristic of fluid delivery. Further, the combination of the outputs of the plurality of pumps sometimes contributes to undesirable wear and tear to the pumps and other related wellbore servicing equipment. Accordingly, there exists a need for a wellbore servicing system and a method of servicing a wellbore that delivers wellbore servicing fluids in a desired manner and with reduced wear and tear on the plurality of pumps and other wellbore servicing equipment.

SUMMARY

Disclosed herein is a method of servicing a wellbore, comprising establishing a pumping profile having a performance plan, operating a first pump according to a first pumping parameter value, and operating a second pump according to the second pumping parameter value. The second pumping parameter value is selected relative to the first pumping parameter value to improve a conformance of a phase sensitive combined pump effect operational characteristic to the performance plan.

Further disclosed herein is a wellbore servicing system, comprising a pump group comprising a plurality of plungers wherein at least some of the plurality of plungers are substantially configured according to an equal phase angle distribution arrangement.

Also disclosed herein is a wellbore servicing system, comprising a pump group comprising a plurality of pumps wherein the sum of the flowrates of the plurality of pumps is substantially equal to a combined pump group flowrate and wherein at least one pumping parameter of the at least one of the plurality of pumps is variable to improve a conformance of a phase sensitive combined pump effect operational characteristic to a pumping profile of the wellbore servicing system.

Further disclosed herein is a method of servicing a wellbore, comprising establishing a pumping profile having a performance plan, operating a first pump to provide pressure pulses according to a first frequency, operating a second pump to provide pressure pulses according to a multiple of the first frequency, and controlling a relative pressure pulse phase between a first pressure pulse provided by the first pump and a second pressure pulse provided by the second pump to improve a conformance of a phase sensitive combined pump effect operational characteristic to the performance plan.

BRIEF DESCRIPTION OF THE DRAWINGS

For a more complete understanding of the present disclosure, and for further details and advantages thereof, reference is now made to the accompanying drawings, wherein.

DETAILED DESCRIPTION

This application discloses systems and methods for increasing wellbore servicing system conformance to desired pumping profiles (explained in greater detail below) even while a plurality of pump outputs are combined. In some wellbore servicing systems, the combination of the outputs of a plurality of pumps can lead to non-conformance with respect to a desired pumping profile because the plurality of pumps and/or a plurality of plungers of the plurality of pumps are operating substantially in-phase, as explained in greater detail below. It will be appreciated that operation of a plurality of pumps and/or plungers substantially in-phase can cause the plurality of pumps to fail to deliver fluids as desired (e.g., according to a pumping profile) and may also damage the pumps and/or other wellbore servicing equipment connected to the pumps.

While explained in greater detail below, the present disclosure provides two primary embodiments for preventing and/or reducing in-phase operation of pumps and/or plungers. A first embodiment for preventing in-phase operation of pumps and/or plungers is accomplished generally by monitoring and/or otherwise controlling a phase of one or more pumps and/or plungers relative to one or more other pumps and/or plungers while the pumps and/or plungers are operated at substantially the same speed and/or flowrate. A second embodiment for preventing in-phase operation of pumps and/or plungers is accomplished generally by monitoring and/or otherwise selectively individually controlling the speed and/or flowrate of operation of the pumps and/or plungers so that in-phase or near in-phase operation is minimized and/or prevented by operating the pumps and/or plungers at different speeds and/or flowrates.

Both of the above solutions provide for allowing an increased conformance to a pumping profile by reducing and/or eliminating substantially in-phase operation of pumps and/or plungers. Further, a wellbore servicing system may be operated according to either embodiment to control and improve the conformance of a wellbore servicing system performance to a pumping profile. Such systems and methods may be useful because many wellbore servicing jobs require substantially strict conformance to a performance plan (e.g., as described below, a performance plan that lays out a desired combined pump flowrate of a wellbore servicing fluid such as a fracturing fluid). In particular, fracturing jobs and gravel pack jobs sometimes require substantial adherence to desired combined pump flowrates. The present disclosure provides an improved system and method for closely conforming to such desired combined pump flowrates and other combined pump effect operational characteristics. Accordingly, a wellbore servicing system 100 is disclosed below that may be operated according to a variety of methods and embodiments described herein.

Figure 1:
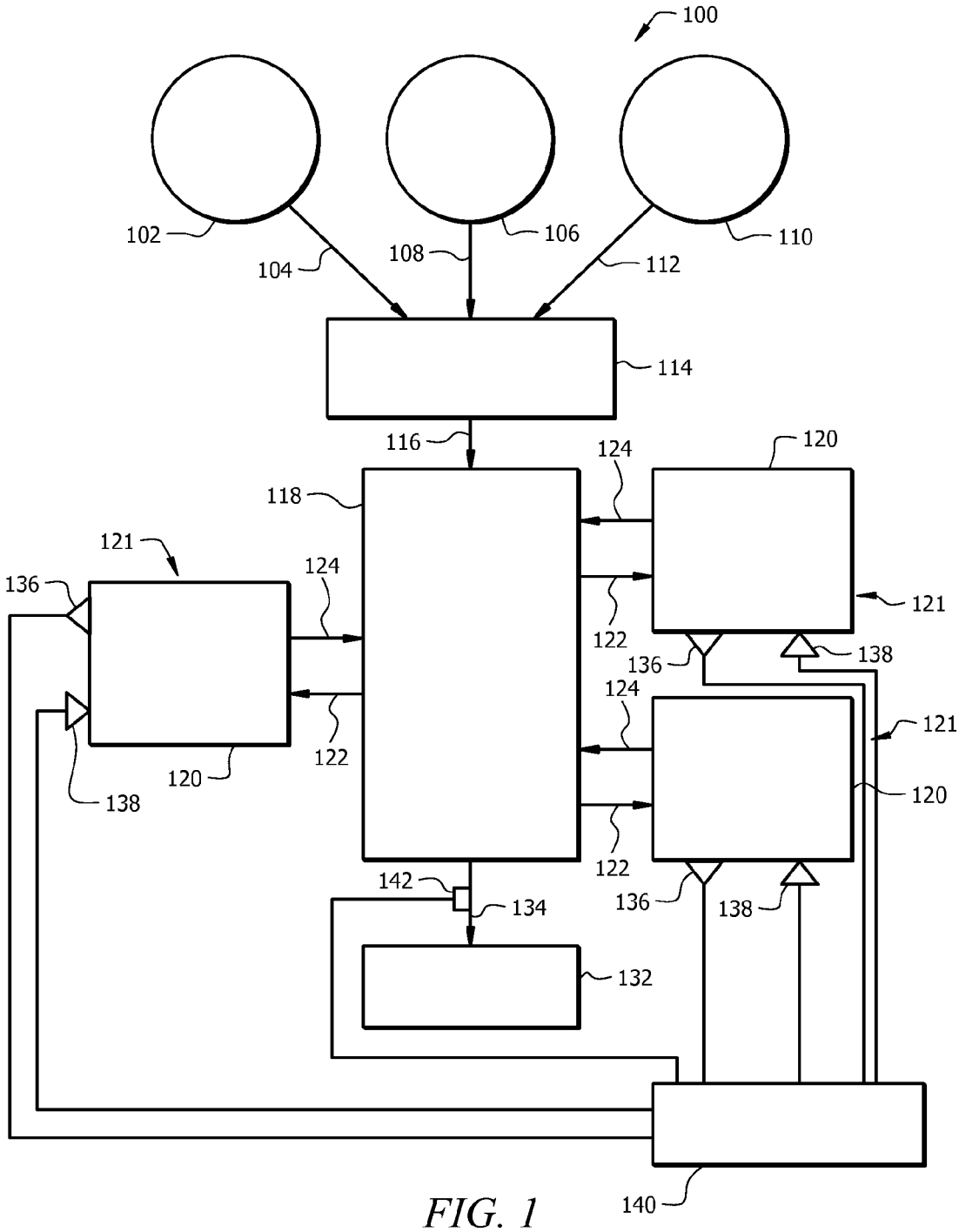
FIG. 1 is a simplified schematic view of a wellbore servicing system according to an embodiment.

Referring to FIG. 1, a wellbore servicing system 100 is shown. The wellbore servicing system 100 may be configured for fracturing wells in low-permeability reservoirs, among other wellbore servicing jobs. In fracturing operations, wellbore servicing fluids, such as particle laden fluids, are pumped at high pressure downhole into a wellbore. In this embodiment, the wellbore servicing system 100 introduces particle laden fluids into a portion of a subterranean hydrocarbon formation at a sufficient pressure and velocity to cut a casing, create perforation tunnels, and/or form and extend fractures within the subterranean hydrocarbon formation. Proppants, such as grains of sand, are mixed with the wellbore servicing fluid to keep the fractures open so that hydrocarbons may be produced from the subterranean hydrocarbon formation and flow into the wellbore. Hydraulic fracturing creates high-conductivity fluid communication between the wellbore and the subterranean hydrocarbon formation.

The wellbore servicing system 100 comprises a blender 114 that is coupled to a wellbore services manifold trailer 118 via a flowline or flowlines 116. As used herein, the term "wellbore services manifold trailer" is meant to collectively comprise a truck and/or trailer comprising one or more manifolds for receiving, organizing, and/or distributing wellbore servicing fluids during wellbore servicing operations. In this embodiment, the wellbore services manifold trailer 118 is coupled via outlet flowlines 122 and inlet flowlines 124 to three positive displacement pumps 120, such as the pump shown in FIG. 5 and discussed in more detail herein. Outlet flowlines 122 supply fluid to the pumps 120 from the wellbore services manifold trailer 118. Inlet flowlines 124 supply fluid to the wellbore services manifold trailer 118 from the pumps 120. Together, the three positive displacement pumps 120 form a pump group 121. In alternative embodiments, however, there may be more or fewer positive displacement pumps used in a wellbore servicing operation and/or the pumps may be other than positive displacement pumps. The wellbore services manifold trailer 118 generally has manifold outlets from which wellbore servicing fluids flow to a wellhead 132 via one or more flowlines 134.

The blender 114 mixes solid and fluid components to achieve a well-blended wellbore servicing fluid. As depicted, sand or proppant 102, water or other carrier fluid 106, and additives 110 are fed into the blender 114 via feedlines 104, 108, and 112, respectively. The fluid 106 may be potable water, non-potable water, untreated, or treated water, hydrocarbon based or other fluids. The mixing conditions of the blender 114, including time period, agitation method, pressure, and temperature of the blender 114, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering the wellbore services manifold trailer 118.

The wellbore servicing system 100 further comprises sensors 136 associated with the pumps 120 to sense and/or report operational information about the pumps 120. The wellbore servicing system 100 further comprises pump control inputs 138 associated with the pumps 120 to allow selective variation of the operation of the pumps 120 and/or components of the pumps 120. In this embodiment, operational information about the pumps 120 is generally communicated to a main controller 140 by the sensors 136. Further, the pump control inputs 138 are configured to receive signals, instructions, orders, states, and/or data sufficient to alter, vary, and/or maintain an operation of the pumps 120. The main controller 140, sensors 136, and pump control inputs 138 are configured so that each pump 120 and/or individual components of the pumps 120 may be independently monitored and are configured so that operations of each pump 120 and/or individual components of the pumps 120 may be independently altered, varied, and/or maintained. The wellbore servicing system 100 further comprises a combined pump output sensor 142. The combined pump output sensor 142 is shown as being associated with flowline 134 which carries a fluid flow that results from the combined pumping efforts of all three pumps 120. The combined pump output sensor is configured to monitor and/or report combined pump effect operational characteristic values (defined and explained infra) to the main controller 140. Alternatively, the combined output can be obtained by summing the output from individual sensors 136.

Figure 5:
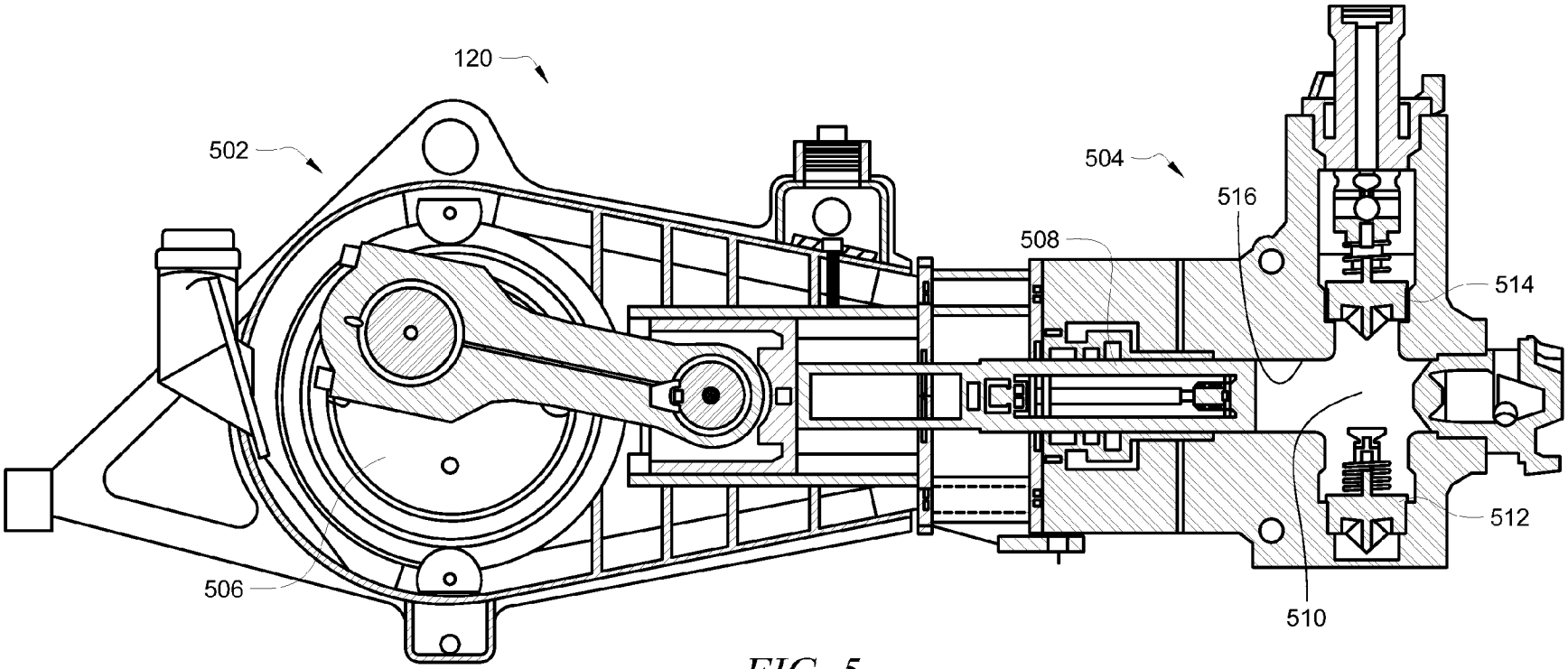
FIG. 5 is a cut-away view of a pump according to an embodiment.

Pumps 120 may be positive displacement pumps, for example of the type shown in FIG. 5. In an embodiment, each of the three pumps 120 is an HT-400™Triplex Pump, produced by Halliburton Energy Service, Inc. However, it will be appreciated that in alternative embodiments, different pumps and/or pump types may be used. Pump 120 comprises a power end 502 and a fluid end 504 attached to the power end 502. The power end 502 comprises a crankshaft 506 rotating through 360 degrees that reciprocates a plunger 508 within a bore 516 of the fluid end 504. The fluid end 504 further comprises a compression chamber 510 into which fluid flows through a suction valve 512. Fluid is pumped out of the compression chamber 510 through a discharge valve 514 as the plunger 508 is moved toward the compression chamber 510.

Figure 2:
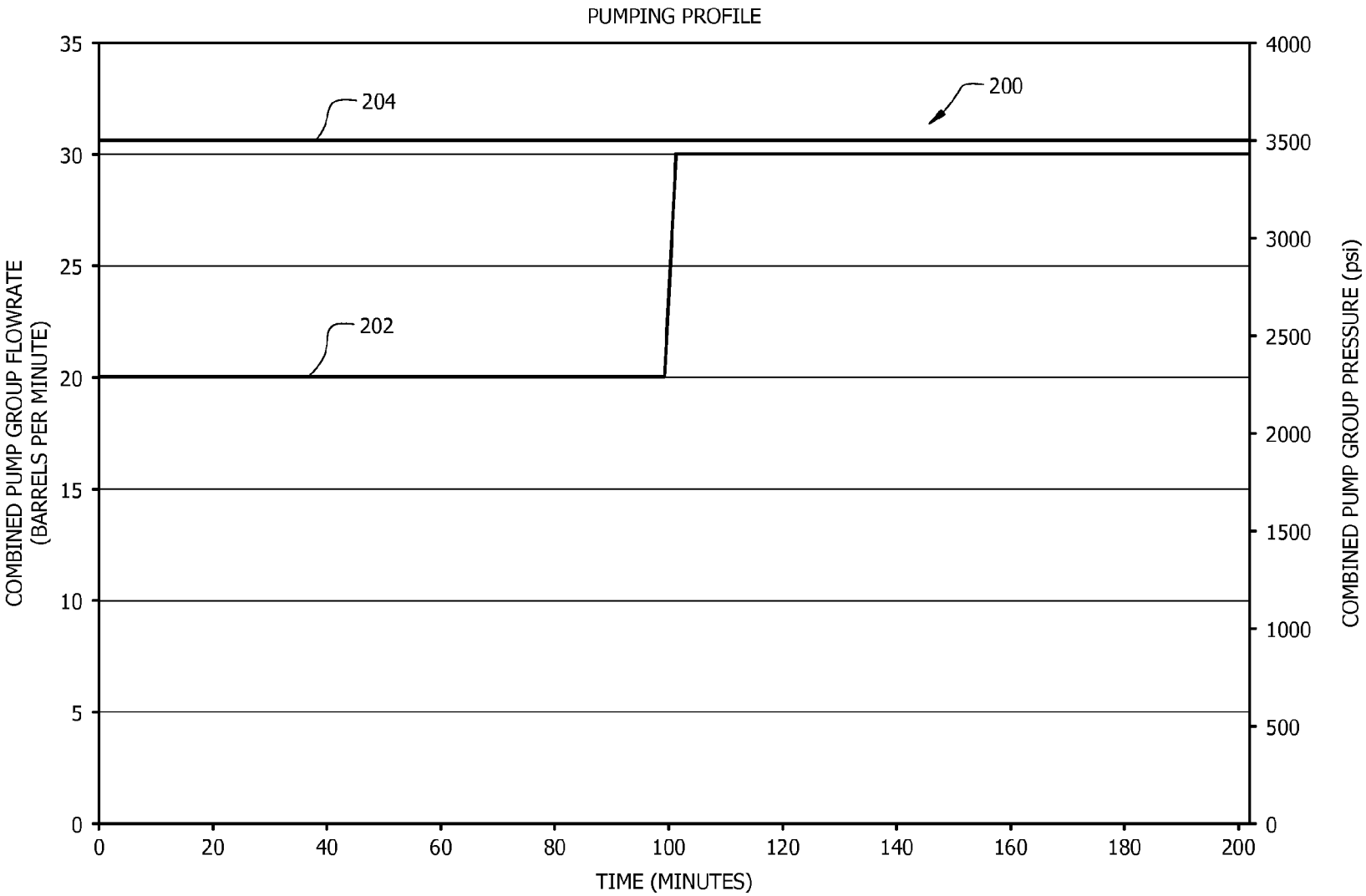
FIG. 2 is a graph of a performance plan according to a pumping profile of the wellbore servicing system of FIG. 1.

In conjunction with a wellbore servicing operation or job, the wellbore servicing system 100 is operable to deliver wellbore servicing fluids to the wellhead 132 according to an established pumping profile 200, for example, as shown in FIG. 2. A pumping profile is defined herein as comprising a performance plan for an operational characteristic of a wellbore servicing system, where the operational characteristic may be varied by varying the operation of at least one pump of a pump group of the wellbore servicing system. It will be appreciated that a single pumping profile may comprise one or more performance plans and that a wellbore servicing system may operate according to one or more pumping profiles, either simultaneously or consecutively. It will further be appreciated that a single pumping profile may comprise one or more performance plans for a single operational characteristic. In other words, a pumping profile may comprise one or more performance plans for one or more operational characteristics of a wellbore servicing system and a wellbore servicing system may operate according to one or more pumping profiles.

Examples of operational characteristics of a wellbore servicing system include, but are not limited to, a combined fluid flowrate of a pump group and a combined rate of change of a fluid flowrate of a pump group. Similarly, operational characteristics of a wellbore servicing system may include, but not be limited to, a combined fluid delivery pressure of a pump group and a combined rate of change of a fluid delivery pressure of a pump group. Similarly, operational characteristics of a wellbore servicing system may include a torque of a pump of a pump group, a rate of change of a torque of a pump of a pump group, a power consumption of a pump of a pump group, and/or a rate of change of power consumption of a pump of a pump group. It will be appreciated that operational characteristics of a wellbore servicing system that are at least partially defined by and/or affected by the combined nature of operation of a plurality of pumps in a pump group may herein be referred to as a combined pump effect operational characteristic. In other words, an operational characteristic of a wellbore servicing system that is impacted by the joinder of the fluid flow outputs of a plurality of pumps of a pump group is herein described as a combined pump effect operational characteristic.

An example of a combined pump effect operational characteristic is clearly represented by the combined fluid flowrate of a pump group because the combined fluid flowrate of a pump group is inextricably related to the sum of the individual fluid flow output rates of each of the pumps of the pump group. While perhaps less easily explained, a torque of a pump of a pump group and a power consumption of a pump of a pump group may also be considered combined pump effect operational characteristics. This is the case because each pump, absent countervailing system components, affects a downstream fluid system (relative to the other pumps of the pump group) that inherently contributes to the torque and power required to operate the other pumps of the pump group. In similar ways, many operational characteristics, including operational characteristics not laid out above, may be properly considered combined pump effect operational characteristics. It will be appreciated that while combined pump output sensor 142 is shown as being associated with flowline 134, it may alternatively be associated with any other component of wellbore servicing system 100 that may provide feedback for monitoring a combined pump effect operational characteristic.

Examples of pumping parameters that may vary operation of a pump of a pump group include, but are not limited to, changing a speed of operation of a pump, changing an upstream or downstream fluid pressure relative to a pump, changing a power consumption of a pump, and changing a torque and/or gearing associated with a pump. Further, the operation of a pump may be varied by changing an internal volume of a pump, changing a slip clutch setting (or similar device setting) of a pump, changing a composition of fluid fed to a pump (i.e., a viscosity or density of the fluid), and/or selectively operating a pump in on and off states. The operation of a pump may further be varied by changing other parameters of pump operation such as, but not limited to, changing an input and/or output fluid flowrate of a pump, changing the set-up of a pump component (e.g., changing a plunger stroke length of a positive displacement pump), or changing a location of a pump component (e.g., a plunger of a positive displacement pump such as a pump 120). Further, changing an electrical voltage supplied to a pump or changing a voltage and/or frequency waveform supplied to a pump (e.g., in a pump comprising a variable frequency drive motor) may vary the operation of a pump.

It will be appreciated that, in some cases, a change to one pumping parameter may in practice lead to a change in another pumping parameter. For example, in some embodiments, changing a speed of a pump may directly affect a flowrate of the same pump. Similarly, in some embodiments, a change in an electrical voltage supplied to a pump may directly affect a speed and a flowrate of the same pump. It will be appreciated that any of the above-listed and/or any other suitable pumping parameters may be used alone or in combination to maintain, change, or otherwise affect an operational characteristic of a wellbore servicing system. Accordingly, varying pumping parameters of a pump of a pump group selectively allows operation of a wellbore servicing system in a manner that conforms to a performance plan of a pumping profile. It will be appreciated that pumping parameters of pumps 120 may be varied by using the main controller 140 to send a signal or otherwise provide the pump control inputs 138 with an instruction to change a pumping parameter.

Referring now to FIG. 2, pumping profile 200 comprises a performance plan for a combined pump group flowrate of the pump group 121 over a period of time. More specifically, the pumping profile 200 is represented as a graph of a desired flowrate delivered downhole in barrels per minute of the pump group 121. The plot of the desired flowrate is performance plan 202. As shown, pump group 121 is tasked with delivering wellbore servicing fluids downhole at a rate of about 20 barrels per minute for about the first 100 minutes of operation. After the first 100 minutes of operation, the flowrate of fluid delivery downhole is increased over approximately 2 minutes to a new desired combined flowrate of approximately 30 barrels per minute. After reaching the flowrate of approximately 30 barrels per minute, the pump group 121 is tasked with continuing to deliver about 30 barrels per minute until about minute 200 of operation.

It will be appreciated that while the performance plan of pumping profile 200 represents a target plan for the combined flowrate delivered downhole over a period of time, the pump group 121 of the wellbore servicing system 100 typically cannot conform precisely, without error, to the performance plan of pumping profile 200. Instead, the pump group 121 is generally capable of conforming closely to the desired combined flowrate, but with short-term transient variability in the actual flowrate. In other words, while the pump group 121 can effectively approximate the desired combined flowrate, the pumps 120 of the pump group 121 and the related wellbore servicing equipment cause the flowrate of the pump group 121 to overshoot and undershoot the target flowrate laid out by the performance plan of the pumping profile 200 while substantially averaging the desired combined flowrate. In this embodiment, the above-described overshooting and undershooting may occur a plurality of times within a given timeframe (e.g., less than one second) of elapsed operation of the pump group 121. It will be appreciated that the above described overshooting and undershooting is attributable to, at least in part, the degree to which a plurality of pumps 120 and/or plungers 508 operate substantially in-phase (explained infra). Accordingly, the combined flowrate of the pump group 121 may be referred to as a phase sensitive combined flowrate operational characteristic.

Pumping profile 200 further comprises a performance plan 204 for a combined pump group pressure, the pressure at which fluids are delivered downhole by pump group 121. In this embodiment, and according to pumping profile 200, the pump group 121 is tasked with delivering wellbore servicing fluids downhole at a pressure of about 3500 psi over the entire about 200 minutes of operation. It will be appreciated that in other embodiments and in this embodiment when operated according to alternative pumping profiles, pump group 121 may be tasked with delivering wellbore servicing fluids downhole at various other pressures over the course of operation of the pump group 121. Pumping profile 200 is an example of a pumping profile that comprises a plurality of performance plans since pumping profile 200 comprises both the performance plan 202 for a combined pump group flowrate and the performance plan 204 for the combined pump group pressure. It will be appreciated that overshooting and undershooting of the desired pressure may occur and is attributable, at least in part, to a degree to which a plurality of pumps 120 and/or plungers 508 operate substantially in-phase (explained infra). Accordingly, the combined pump group pressure of the pump group 121 may also be referred to as a phase sensitive combined flowrate operational characteristic. Any combined pump effect operational characteristic that is affected by a relative phase angle between plungers 508 and/or pumps 120 may be referred to as a phase sensitive combined pump effect operational characteristic.

Figure 8:
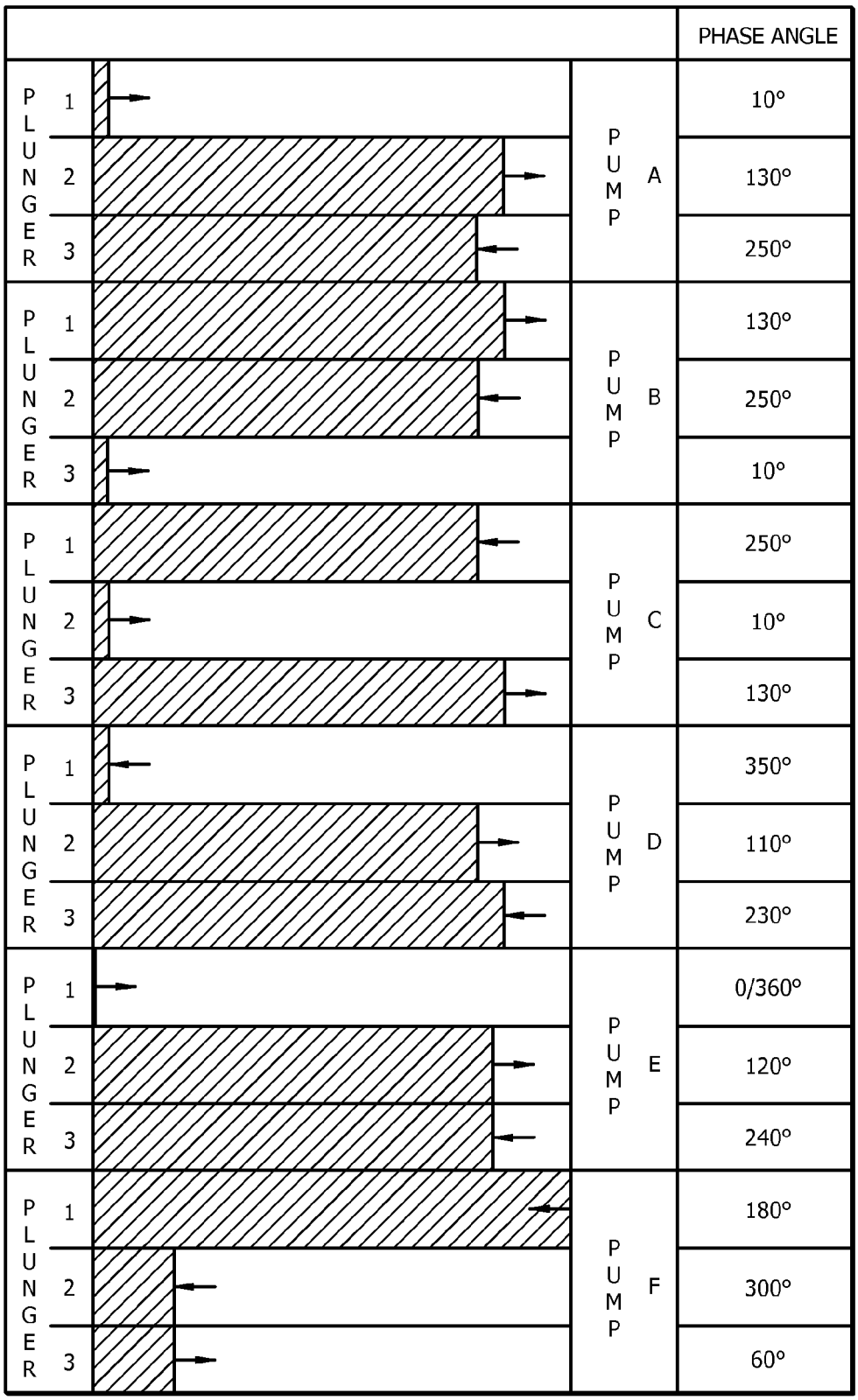
FIG. 8 is a diagram explaining plunger phase angles of various pumps.

Referring now to FIG. 8, an explanatory schematic of plunger locations within a bore is provided. Each of pumps A-E comprises three plungers that reciprocate within their respective bores. Positive displacement pumps may generally comprise one or more plungers, but the following discussion refers to positive displacement pumps each comprising three plungers. The following discussion further refers to positive displacement pumps in which the multiple plungers of each pump are generally equally angularly offset. For example, in the positive displacement pumps described here which comprise three plungers, the three plungers are angularly distributed to have 120 degrees of separation, thereby minimizing undesirable effects of having plural plungers of a single pump simultaneously producing pressure pulses. The position of the plungers is described by the number of degrees the pump's crankshaft has rotated from the bottom dead center position. The bottom dead center position is the position of the plunger when it is fully retracted at zero velocity just prior to moving forward in its bore. A plunger is defined as being in-phase with another plunger only when the two plungers are both (1) located in the same position within their respective bores and (2) when the two plungers have the same direction of travel as indicated in FIG. 8 by arrows originating from the plungers. Accordingly, pumps A, B, and C are in phase because each pump has plungers at the same position and same direction. When one plunger is in phase, if there are the same number of plungers in each pump, then all of the plungers will be in phase. Another way for two or more pumps to be in phase is for there to be a different number of plungers in each pump, but the rotational speeds of the pumps be such that there are the same number of plunger strokes per unit of time for each pump. For example, a three plunger pump and a five plunger pump can be in phase if the speed of the three plunger pump is five thirds the speed of the five plunger pump. Pump D is out of phase with pumps A, B and C. Pump D has plungers in the same position as pumps A, B, and C, but the direction of the plungers is opposite due to the angle of the crankshaft being different.

FIG. 8 shows that a phase angle of 0°/360° may be assigned to a plunger located fully to the left (see Pump E plunger 1) (representing a fully retracted position) while a phase angle of 180° may be assigned to a plunger located fully to the right (see Pump F plunger 1) (representing a plunger being fully extended within a bore). As discussed herein, a full single stroke of a plunger 508 within a bore 516 (where a plunger 508 begins movement from a start position and ends movement in the same position) is considered movement of a crankshaft through 360 degrees that is connected to and driving the plunger 508. For simplicity, this is referred to as the plunger 508 moving through 360 degrees. Further, it will be appreciated that when all of the plungers 508' of a first pump 120' are substantially in-phase with all of the plungers 508" of a second pump 120", the first and second pumps 120', 120" are referred to as being in-phase with each other. Two pumps can remain substantially continuously in phase if each of the pumps are operated at substantially the same speed. However, if the two pumps are operated at different speeds, the pumps can only be temporarily in phase and will continually shift from being in phase to being out of phase. The rate at which the two pumps change from being in phase to being out of phase depends on the difference in speed between the two pumps. Larger speed variations result in more frequent shifts from being in phase to being out of phase and the period during which the pumps are in phase before being out of phase is shortened. Similarly, smaller speed differences between the two pumps results in less frequent shifts from being in phase to being out of phase and the period during which the pumps are in phase before being out of phase is lengthened. Two pumps will also stay in phase when the speed of one pump is a multiple of the speed of the other pump. Further, another condition where two pumps stay in phase occurs when two pumps with different numbers of plungers are operated so that the speed of the pump with fewer plungers is operated at a speed equal to the speed of the pump with more plungers times the ratio of the number of plungers in the pump with more plungers to the number of plungers in the pump with fewer plungers. Even when operated at the required speed ratio for in phase operation, the position of plungers must be the same for both pumps.

In this disclosure, when a group of plungers (e.g., all or some of the total plungers in a pump group) are evenly spread over the entire 360 degrees of movement, the arrangement for that group of plungers may be referred to as an "equal phase angle distribution." For example, a wellbore servicing system may comprise three pumps having five plungers each, totaling fifteen plungers. The fifteen plungers may be operated out of phase where the fifteen plungers are configured to be phase-shifted by 24 degrees (according to the relationship of 360 degrees being separated evenly by the fifteen plungers). In some embodiments, the above equal phase angle distribution may be accomplished by first providing each pump with the five plungers being offset by 72 degrees, thereby spreading the five plungers of each pump over the entire 360 degrees. With the three pumps arranged as such, the equal phase angle distribution may be completely accomplished by maintaining a 24 degree offset between the otherwise identical pumps, thereby ensuring that during pumping, no two plungers are located at the same location along their respective stroke paths. In this disclosure, such reference to angularly offsetting pumps relative to each other may be referred to as establishing a relative phase angle between pumps.

Further, alternative plunger phase shifting may be accomplished for any number of plungers of other alternative embodiments by dividing the full 360 degrees by the total number of plungers in the pump group. Equal phase angle distribution is particularly useful where a pump group comprises primarily a plurality of substantially similar pumps, each pump having the same number of plungers and each pump being capable of operating at the same speed as the speed of other pumps in the pump group.

A further approach to controlling a pump group is to consider the existence of pressure pulses that result from the stroking action of each of the individual plungers within a pump group. It will be appreciated that while the previously discussed equal phase angle distribution is beneficial to pump groups comprising substantially similar pumps (e.g., pumps that have the same number of plungers and are capable of running at substantially the same speeds), alternative embodiments of pump groups may comprise pumps with different numbers of plungers. For example, a pump group may comprise a Triplex pump (having three plungers) and a Quintuplex pump (having five plungers). It will be appreciated that if pressure pulsations produced by multiple plungers of the pump group occur substantially simultaneously or coincidentally, the ability of the pump group to conform to a performance plan of a pumping profile may be compromised.

Generally, if the pumps of a pump group are operated to meet two criteria described below, coincidental occurrences of pressure pulsations attributable to multiple plungers providing pressure pulses simultaneously can be prevented. First, the pumps may be operated so that the pumps each provide pressure pulsations at substantially the same frequency. In other words, each of the pumps may be operated to provide the same number of pressure pulsations per unit of time. Second, the pumps may be operated to ensure that the pressure pulsations of the pump group occur so that the pressure pulsations are alternatingly attributable to the pumps. In other words, a first pressure pulsation may be caused by a first pump, the following second pressure pulsation may be caused by a second pump, and the following third pressure pulsation may be caused by the first pump. Finally, the above operation may be further optimized by ensuring substantially equal time periods between adjacent pressure pulsations in time. For example, the time between the above-described first and second pressure pulsations may be substantially equal to the time between the above-described second and third pressure pulsations. If the two pumps are operated in the above-described manner, the pressure pulsations generated by the pump group will not coincide, thereby preventing undesirable higher pressures that would be attributable to the additive effects of coincidental pressure pulsations. It will be appreciated that controlling the previously described pump group 121 according to an equal phase angle distribution inherently achieves prevention of coincidental pressure pulsations.

In the case of a pump group comprising a Triplex pump and a Quintuplex pump, both pumps may generate the same pressure pulse frequencies and the same flow frequencies. As such, the pressure pulsations generated by the pumps may be managed and/or controlled to be time shifted to ensure that pressure pulsations of the pumps do not occur substantially simultaneously. Such management of the relative pressure pulsation timing of the different pumps may be referred to as relative pulse phase control. In some embodiments, the phase between pulses may be controlled by determining the time of a pressure pulsation caused by a first pump and by thereafter maintaining a second pump with a fixed time delay between the pressure pulsations caused by the second pump and the pressure pulsations caused by the first pump. The time delay corresponds to the maintenance of a phase shift between the pressure pulsations of the first pump and the pressure pulsations of the second pump.

Figure 12A:
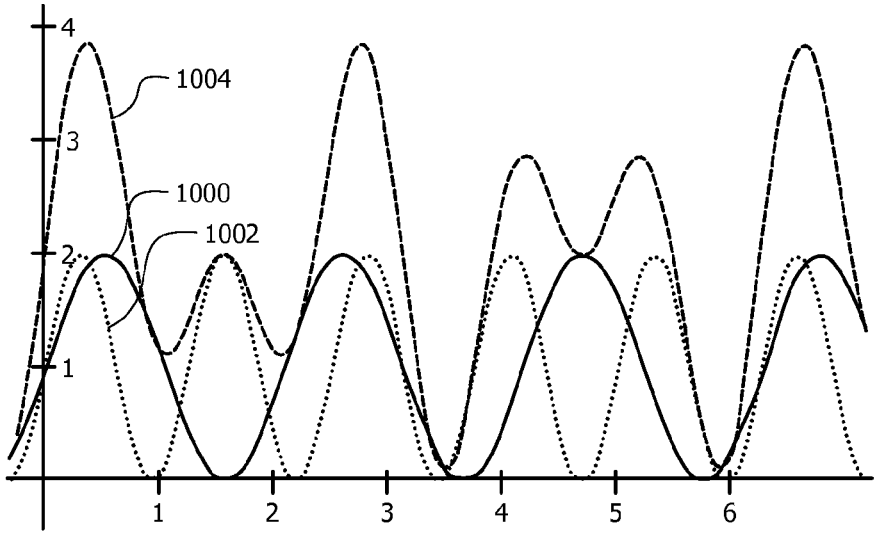
FIG. 12A shows simplified pressure pulsation waveforms of a pump group comprising a Triplex pump and a Quintuplex pump in an initial mode of operation.
Figure 12B:
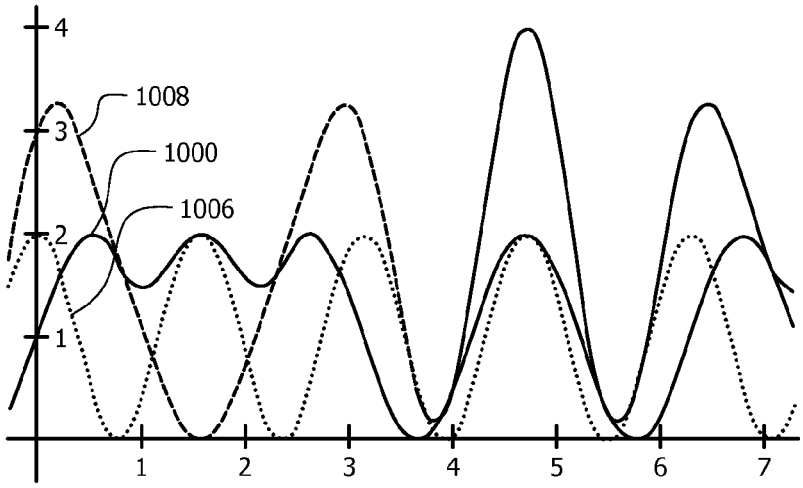
FIG. 12B shows simplified pressure pulsation waveforms of the pump group of FIG. 12A in an intermediate mode of operation.
Figure 12C:
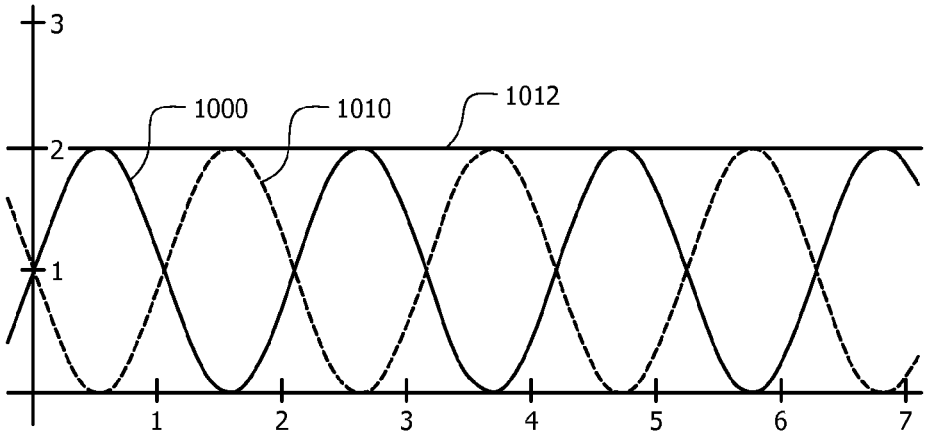
FIG. 12C shows simplified pressure pulsation waveforms of the pump group of 12A in an optimized mode of operation.

Referring now to FIGS. 12A-12C, simplified waveform representations of the pressure pulses generated by a pump group comprising a Triplex pump and a Quintuplex pump are shown. FIG. 12A shows the resultant pressure pulse waveforms while operating the pumps in and initial stage of operation. FIG. 12B shows the resultant pressure pulse waveforms while operating the pumps in an intermediate stage of operation. FIG. 12C shows the resultant pressure pulse waveforms while operating the pump in an optimized stage of operation. The x-axes of the plots of FIGS. 12A-12C are representative of time while the y-axes represent pressure. The scales and units of the plots of FIGS. 12A-12C are not intended to represent actual operating values, but rather, provide a common reference for comparing relative values of the waveforms of the plots.

Referring to FIG. 12A, in this embodiment, the Triplex pump is operated at a speed that produces the pressure pulsation waveform 1000 (represented by the simplified function of (sin(3x)+1)) while the Quintuplex pump is operated at a speed that produces the pressure pulsation waveform 1002 (represented by the simplified function of (sin(5x)+1)). In this initial stage of operating the pumps, it is clear that the additive sum of the waveforms 1000 and 1002, represented by pressure pulsation waveform 1004, results in higher pressure pulses than are otherwise generated by the waveforms 1000 and 1002 individually. It will be appreciated that in the initial stage of operation of the pumps as shown in FIG. 12A, the Triplex pump is producing three pressure pulsations within the same period of time that the Quintuplex pump is producing five pressure pulsations. In other words, the pressure pulse frequencies of the two pumps are not substantially equal. It will also be appreciated that in the initial stage of operation of the pumps as shown in FIG. 12A, the Triplex pump and the Quintuplex pump start operation at time=0 with their waveforms 1000 and 1002, respectively, in phase with each other. Of course, since the frequency of the pressure pulsations of the different pumps is not equal, the pressure pulsations of the waveforms 1000 and 1002 drift relative to each other over time and periodically go into phase and out of phase.

Referring now to FIG. 12B, in this embodiment, the intermediate stage of operating the pumps is shown. While management of the pump group was described above as being accomplished by first altering the speed of the pumps so that the pumps provide pressure pulsation at the same frequency prior to accomplishing a phase shift between pressure pulsations (or a phase shift between the waveforms representative of the pressure pulsations), it will be appreciated that altering the speed and altering the phase shift may be worked toward substantially simultaneously. Referring now to FIG. 12B, it is shown that the operation of the Triplex pump remains unchanged while the operation of the Quintuplex pump is altered to provide the pressure pulsation wave form 1006 (represented by the simplified function of (sin(4x+(3.14/2)+1))). The waveform 1006 represents a change in operation of the Quintuplex pump that is approximately halfway toward each of the goals of operating at the same frequency as the Triplex pump and operating so that the Quintuplex pressure pulsation waveform is out of phase with the Triplex pump. It is clear that the additive sum of the waveforms 1000 and 1006, represented by pressure pulsation waveform 1008, still results in higher amplitude pressure pulses than are otherwise generated by the waveforms 1000 and 1006 individually. It is also apparent from comparing pressure pulsation waveforms 1004 and 1008 that waveform 1008 comprises fewer high pressure pulses per unit time and that the average amplitude of the pulses of the waveform 1008 is lower than the average amplitude of the pulses of the waveform 1004. Accordingly, operation of the pump group according to the waveforms of FIG. 12B is generally an improvement as compared to operating the pump group according to the waveforms of FIG. 12A.

Referring now to FIG. 12C, a simplified view of an optimized stage of operating the pump group is shown. Specifically, while the operation of the Triplex pump has remained unchanged, the operation of the Quintuplex pump has further been altered to generate the waveform 1010 (represented by the simplified function of (sin(3x+3.14)+1)). In this optimized stage of operation, the pumps are operated so that each pump generates pressure pulses at substantially the same frequency but with the pressure pulses of the different pumps being phase shifted and/or time shifted so that pressure pulses of the Triplex pump occur between pressure pulses of the Quintuplex pump. In this optimized stage of operating the pumps, it is clear that the additive sum of the waveforms 1000 and 1010, represented by pressure pulsation waveform 1012, result in further reduction and/or elimination of pressure pulses having amplitudes in excess of the amplitudes of the pressure pulses generated individually by the pumps as compared to the waveform 1008. Therefore, the above discussion discloses that controlling operation of the two pumps having different numbers of plungers according to the methods described above, pressure pulsations of a pump group can be controlled to minimize fluctuations in pressure provided by the pump group as a whole. More specifically, ensuring equal pressure pulse frequency and using relative pulse phase control to time shift the pressure pulses may be used to improve pump group performance and/or adherence to a performance plan of a pumping profile.

Figure 13A:
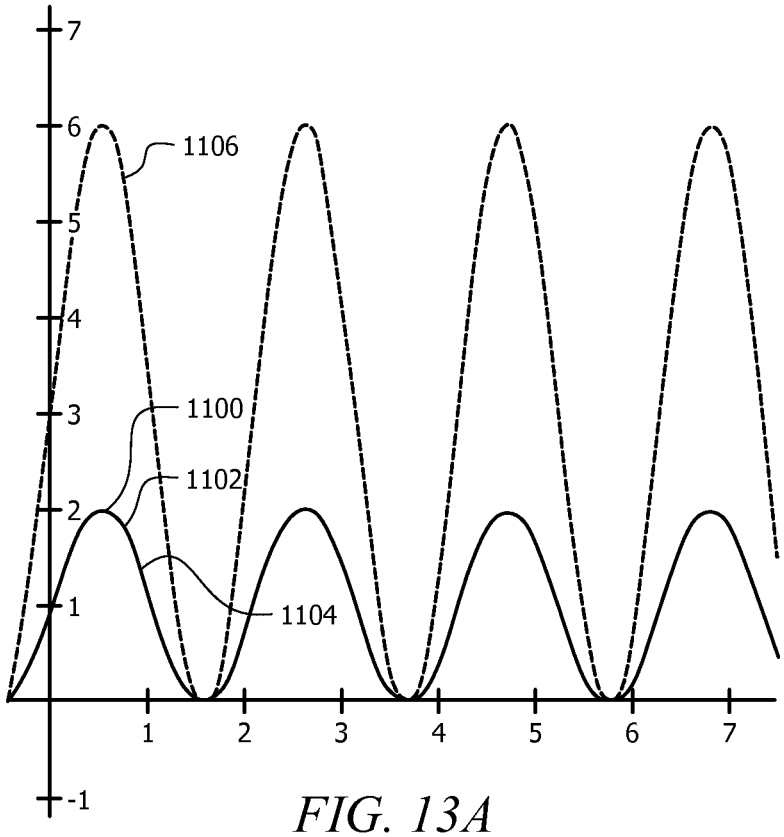
FIG. 13A show simplified pressure pulsation waveforms of an alternative embodiment of a pump group that comprises three Triplex pump.
Figure 13B:
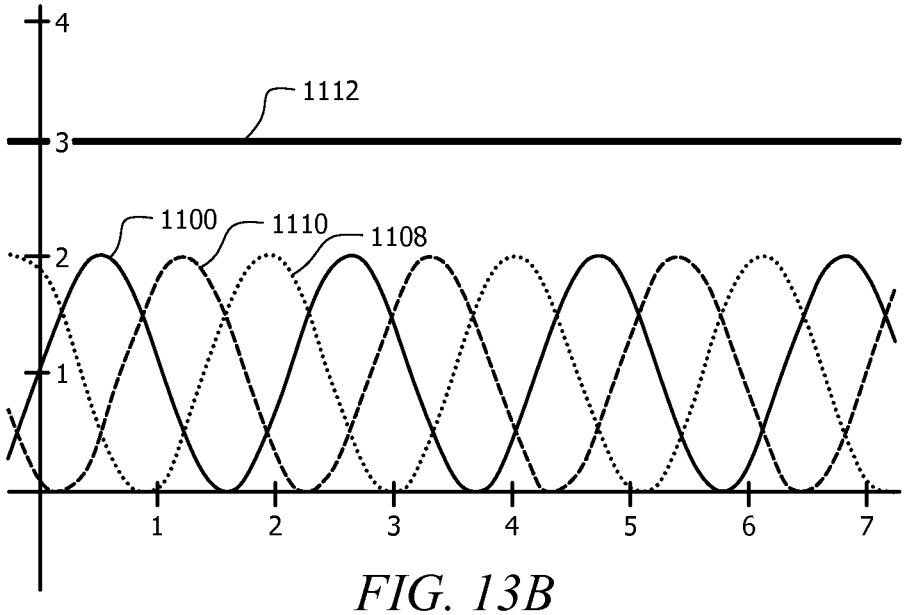
FIG. 13B shows simplified pressure pulsation waveforms of the pump group of FIG. 13A in an optimized mode of operation.

Referring now to FIGS. 13A and 13B, simplified waveform representations of the pressure pulses as generated by the pump group 121 are shown. As discussed above the pump group 121 comprises three Triplex pumps 120', 120", and 120'". FIG. 13A shows the resultant pressure pulse waveforms while operating the pumps 120', 120", and 120'" in an initial stage of operation. FIG. 13B shows the resultant pressure pulse waveforms while operating the pump in an optimized stage of operation. The x-axes of the plots of FIGS. 13A-13B are representative of time while the y-axes represent pressure. The scales and units of the plots of FIGS. 13A-13B are not intended to represent actual operating values, but rather, provide a common reference for comparing relative values of the waveforms of the plots.

When operating pumps having different numbers of plungers, the pumps speeds to avoid may be avoided by preventing the speed of the pump with the larger number of plungers (e.g., Quintuplex pump) from being equal to any multiple of the number of plungers (e.g., three) in the pump with fewer plungers (e.g., Triplex) divided by the number of plungers (e.g., five) in the pump with more plungers (e.g., Quintuplex). In other words, with respect to a pump group comprising a Triplex pump and a Quintuplex pump, in phase operation of the pumps may be avoided by ensuring that the crankshaft speed of the Quintuplex pump is not ⅗ of the crankshaft speed of the Triplex pump, or any whole unit multiple thereof. Nonetheless, if the pumps are operated at the above-described undesirable speed ratios, phase shifting the pressure pulsation occurrences between the two pumps may be used minimize potential additive effects of coincidental pressure pulsations.

Referring to FIG. 13A, in this embodiment, the Triplex pumps 120', 120", and 120'" are operated at a speed that produces the pressure pulsation waveforms 1100, 1102, and 1104, respectively, each being represented by the simplified function of (sin(3x)+1)). In this initial stage of operating the pumps 120', 120", and 120'" are operated at the same speed, are in phase, and provide pressure pulsations at the same frequencies. It is clear that the additive sum of the waveforms 1100, 1102, and 1104, represented by pressure pulsation waveform 1106, results in higher pressure pulses than are otherwise generated by the waveforms 1100, 1102, and 1104 individually. With the pumps 120', 120", and 120'" already being operated to provide pressure pulsations at the same frequencies, the above-described pulse phase control method may be used to provide a phase shift or time shift between the pulsations to reduce the overall amplitude of the resultant additive waveform.

Referring now to FIG. 13B, a simplified view of an optimized stage of operating the pump group 121 is shown. Specifically, while the operation of the pump 120' has remained unchanged, the operation of the pump 120" and pump 120'" are altered to generate the waveforms 1108 and 1110, respectively. The waveforms 1108 and 1110 are represented by the simplified functions of (sin(3x+2(3.14/3))+1) and (sin(3x−2(3.14/3))+1), respectively. In this optimized stage of operation, the pumps 120', 120", and 120'" are operated so that each pump successively in turn provides a pressure pulse and so that the time period between adjacently occurring pressure pulses is substantially equal. It is clear that the additive sum of the waveforms 1100, 1108, and 1110, represented by pressure pulsation waveform 1112, result in reduction of pressure pulse amplitudes as compared to waveform 1106. Therefore, the above discussion discloses that by controlling operation of the three pumps having the same number of plungers according to the methods described above, pressure pulsations of a pump group can be controlled to minimize fluctuations in pressure provided by the pump group as a whole. Accordingly, ensuring equal pressure pulse frequency and using relative pulse phase control to time shift the pressure pulses may be used to improve pump group 121 performance and/or improve adherence to a performance plan of a pumping profile.

The above describes systems and method for effectively controlling pump groups comprising pumps having the same number of plunger and pump groups comprising different numbers of plungers. Specifically, the pump groups comprising pumps with the same number of plungers may be controlled by monitoring and or controlling the pump group according to an equal phase angle distribution through the establishment of equal phase angle separation between the total number of plungers. However, the pump groups comprising pumps having different numbers of plungers and the pump groups comprising pumps having equal numbers of plungers may be controlled by monitoring and/or controlling the pressure pulsation timing of the various pumps to avoid coincidence of pressure pulsations and/or to evenly spread the pressure pulsations generated by the pump group over time. It will be appreciated that each of the above types of pump groups are therefore monitored and/or controlled to prevent or minimize pressure pulsation overlap and/or coincidence and that various pumping parameters may be used to control phase sensitive combined flowrate operational characteristics of the respective pump groups. It will further be appreciated that the systems and method of controlling the pump groups comprising pumps having different numbers of plungers may be used to control pump groups having pumps with the same number of plungers. Similarly, in some embodiments, the systems and methods of controlling the pump groups comprising pumps having the same number of plungers may be used to control pump groups having pumps with different numbers of plungers.

In some embodiments, the wellbore servicing system 100 may be operated to provide an improved conformance to a phase sensitive combined pump effect operational characteristic. For example, where the wellbore servicing system 100 is tasked with performing according to the pumping profile 200, it may be advantageous to monitor and/or control a phase angle of one or more plungers 508 and/or pumps 120 to limit, reduce, and/or eliminate in-phase operations of plungers 508 and or pumps 120, thereby increasing conformance to the pumping profile 200. For instance, for the wellbore servicing system 100 to more closely conform to the performance plan 202, the wellbore servicing system 100 may first select a first pump 120' and operate the first pump 120' according to a first pumping parameter value. For example, the main controller 140 may select the first pump 120' and send a signal to the first pump 120' via the pump control input 138' so that the first pump 120' operates at an output flowrate of 5 barrels per minute. The signal sent through the pump control input 138' may represent a desired speed of the pump 120' and/or a desired number of rotations per minute of crankshaft 506'.

The main controller 140 may monitor and/or otherwise manage the output flowrate of the pump 120' using feedback from the sensor 136'. With the first pump 120' operating at the desired flowrate of 10 barrels per minute, the main controller 140 may calculate that between the second pump 120" the third pump 120'", another 10 barrels per minute of output flowrate is necessary to meet the demands of pumping profile 200. Accordingly, the main controller 140 may select the second pump 120" third pump 120'" to each have output flowrates of 5 barrels per minute such that the combined total pump group 121 flowrate is substantially equal to the required 20 barrels per minute dictated by the pumping profile 200. To increase conformance to the pumping profile 200, the main controller 140 may monitor and/or select a phase angle for plungers 508' of the first pump 120' and thereafter monitor and/or select a phase angle for plungers 508" of second pump 120" as well as monitoring and/or selecting a phase angle for plungers 508'" of the third pump 120'" in a manner calculated to reduce and/or minimize in-phase operation amongst the various plungers 508.

It will be appreciated that such selection and management and/or adjustment of a phase angles for plungers 508", 508'" relative to the phase angle of plungers 508' may, in some embodiments, be accomplished by momentarily increasing or decreasing a speeds of the pumps 120", 120'" and others. In that manner, the momentary increase or decrease in speed of pumps 120", 120'" can be managed to result in known and/or desired phase angle adjustments for plungers 508", 508'" relative to the phase angle of the plungers 508'. By reducing in-phase operation amongst the various plungers 508, phase sensitive combined pump effect operational characteristics exhibit less variation from and greater conformance to the pumping profile 200.

It will be appreciated that because each of the above-described pumps 120', 120", and 120'" each comprise the same number of plungers and each comprise plungers having fixed relative angular offsets to the other plungers of the same pump, the pumps 120', 120", and 120'" themselves may be conceptualized as having a single angular value. In other words, for example, a first plunger of pump 120' may serve to indicate the overall phase angle of the pump 120'. In a similar manner, substantially similar first plungers of pumps 120", 120'" may serve to indicate the overall phase angle of the pumps 120", 120'", respectively. In using such a convention of overall pump phase angle definition, the pumps 120', 120", and 120'" may be controlled to be out of phase with each other by monitoring and/or controlling only the similar first plungers of the pumps. Such a convention of controlling the pumps is enabled by the pumps each having the same number of plungers and the plungers of each of the pumps being equally angularly offset as described above.

It will further be appreciated that in alternative embodiments, pumps may comprise plungers and related mechanisms that allow selective adjustment of the location of plungers along the stroke path of the plunger relative to the crankshaft that otherwise normally moves the plunger along the stroke path. In other words, alternative embodiments may comprise plungers that can be individually adjusted relative to the crankshaft and/or relative to other plungers within the same pump. Such flexibility in selectively adjusting the phase angle of individual plungers may be used to control relative phase angles between plungers and pumps to reduce in phase operation amongst the various plungers and/or pumps, thereby enabling less variation in phase sensitive combined pump effect operational characteristics and stricter adherence to a performance plan of a pumping profile.

In some other embodiments, the wellbore servicing system 100 may be operated to provide an improved conformance to a performance plan that dictates target values for a phase sensitive combined pump effect operational characteristic. For example, to prevent in-phase operation of plungers 508 and/or pumps 120, the main controller 140 may directly manage speeds of the plungers 508 and/or pumps 120. More specifically, since operating plungers 508 and/or pumps 120 at substantially different speeds acts to prevent and/or minimize prolonged in-phase operation of the plungers 508 and/or pumps 120, the main controller 140 may be configured to provide different operating speeds of plungers 508 and/or pumps 120. In some embodiments, the main controller 140 may calculate appropriate speeds for the plungers 508 and/or pumps 120 so that in-phase operation is reduced, minimized, and/or eliminated while still allowing the pumps 120 to provide the phase sensitive combined pump effect operational characteristic value required by the pumping profile 200. It will be appreciated that the main controller 140 may by configured to prevent operation of plungers 508 and/or pumps 120 at speeds representing harmonic intervals of the speeds of other plungers 508 and/or pumps 120 (e.g., speeds that are substantially ½, ¼, ⅛, 1/16, etc. of another operating speed). While in those embodiments, plungers 508 and/or pumps 120 may be managed to operate at substantially constant speeds, in other embodiments, one or more plungers 508 and/or pumps 120 may be managed by the main controller 140 to be operated with a rate of change of speed (e.g., an inherent or built-in drift in speed). While an example is provided below that embodies a linear rate of change of speed for plungers 508 and/or pumps 120, this disclosure expressly contemplates the main controller 140 managing one or more plungers 508 and/or pumps 120 to have a non-linear rate of change of speed. As previously noted, when running pumps with different numbers of plungers, the speeds can be different yet still be in phase. Most generally, a total number of plunger pulsations are controlled to be at different speeds while substantially restricting occurrences of the plunger pulsations being at multiples of the speeds of other plunger pulsations.

It will be appreciated that selection of a speed for one or more plungers 508 and/or one or more pumps 120 may be at least partially randomly selected. Similarly, it will be appreciated that the selection of a rate of change of speed for one or more plungers 508 and/or one or more pumps 120 may be at least partially randomly selected. Still further, it will be appreciated that speeds and/or rates of change of speeds may be selected according to a predetermined time schedule, or alternatively, may be selected according to an at least partially random time schedule.

Similarly, while the above-described control of plungers 508 and/or pumps 120 refers to controlling a speed, other pump parameters described herein may be managed to have linear and/or non-linear rates of change while still providing a phase sensitive combined pump effect operational characteristic performance that exhibits less transient variation from the performance plan 202 of the pumping profile 200.

It will also be appreciated that main controller 140 may be configured as a linear or non-linear controller. Without being limited to these controller types, linear controllers may comprise proportional, proportional-integral and/or proportional-integral-derivative controllers. Without being limited to these controller types, non-linear controllers may comprise fuzzy logic, sliding mode, artificial intelligence based controllers. The controller is programmed to (1) sense information about the operation of pumps 120 and/or sense information about a phase sensitive combined pump effect operational characteristic value and (2) based on the sensed information, control the plungers 508 and/or pumps 120 according to a set of control parameters (e.g., by altering one or more pump parameters such as speed, etc.).

Figure 9:
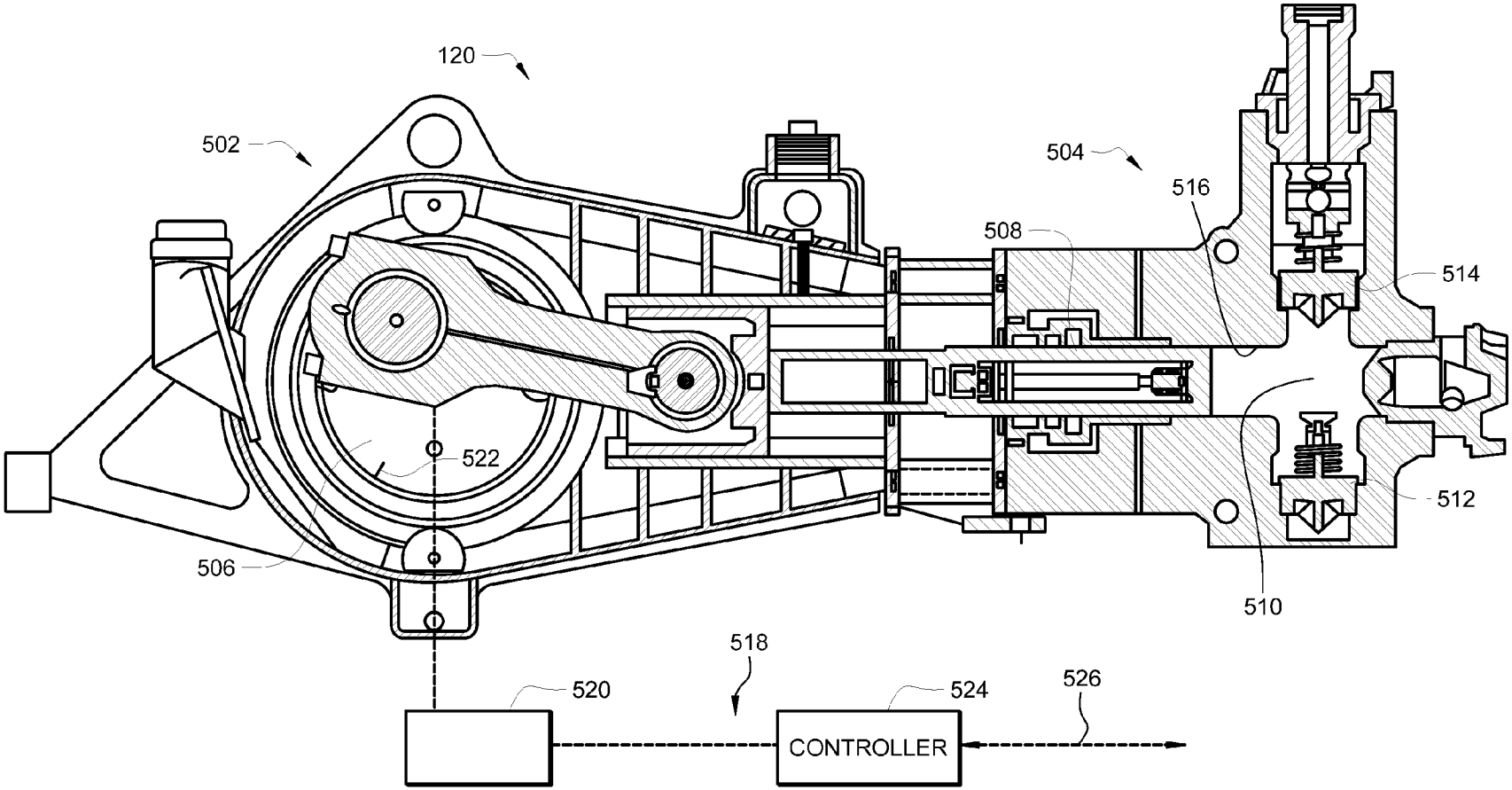
FIG. 9 is a cut-away view of a pump according to another embodiment.

Referring now to FIG. 9, an alternative embodiment of a pump 500 is shown that may be used in place of and/or in addition to pumps 120. Pump 500 is substantially similar to pump 120 but further comprises a phase control system 518 for sensing, monitoring, and/or establishing a phase location of plunger 508. A sensor 520 detects a plunger location and/or velocity based on the location of a timing marker 522 that is carried on the crankshaft 506. The phase control system 518 further comprises a pump controller 524 that uses the sensed plunger location information to report, adjust, and/or record the location and/or phase of the plunger 508. Of course, the pump controller 524 may be connected to other systems, computers, monitors, controllers, and/or other suitable equipment for operating and monitoring the pump 500 to affect combined pump effect operational characteristic values. In this embodiment, the phase control system 518 may be configured to alter a phase of the plunger 508 relative to the phase of a different plunger 508 by momentarily increasing and/or decreasing a speed of operation of the pump 500. More specifically, the phase control system 518 may be used to maintain, in some embodiments, an equal phase-shift arrangement between a group of plunger 508, thereby improving conformance of a phase sensitive combined pump effect characteristic to a pumping profile. It will be appreciated that communication may take place between the pump controller 524 and the main controller 140 and/or other systems may be bi-directional or uni-directional and may take place over a bi-directional communications link 526. In this and other similar embodiments, communication between the pump controller 524 and the main controller 140 occurs to enable adjustments to pumping parameters (e.g., pump speed) through the use of pump control inputs 138.

In other embodiments, the phase control system 518 may be used to control a speed of the pump 500, a flowrate of the pump 500, or any other operational characteristic of the pump 500 that may be deduced and/or subsequently controlled by monitoring and/or managing the speed of the crankshaft 506 as reported by sensor 520. Of course, in alternative embodiments, the phase control system 518 may be self-contained and may comprise other systems or components for managing, monitoring, reporting, and/or altering a phase and/or speed of the plunger 508. It will be appreciated that while pump 500 comprises only one phase control system 518, each of the other two plungers of the pump 500 may be associated with an independent phase control system 518. It will further be appreciated that instead of a sensor 520 that senses crankshaft 506 information, in alternative embodiments, a sensor may be provided in the phase control system 518 that directly or indirectly measures and/or reports the location and/or phase of the plunger 508, for example as shown in FIGS. 10 and 11.

Figure 10:
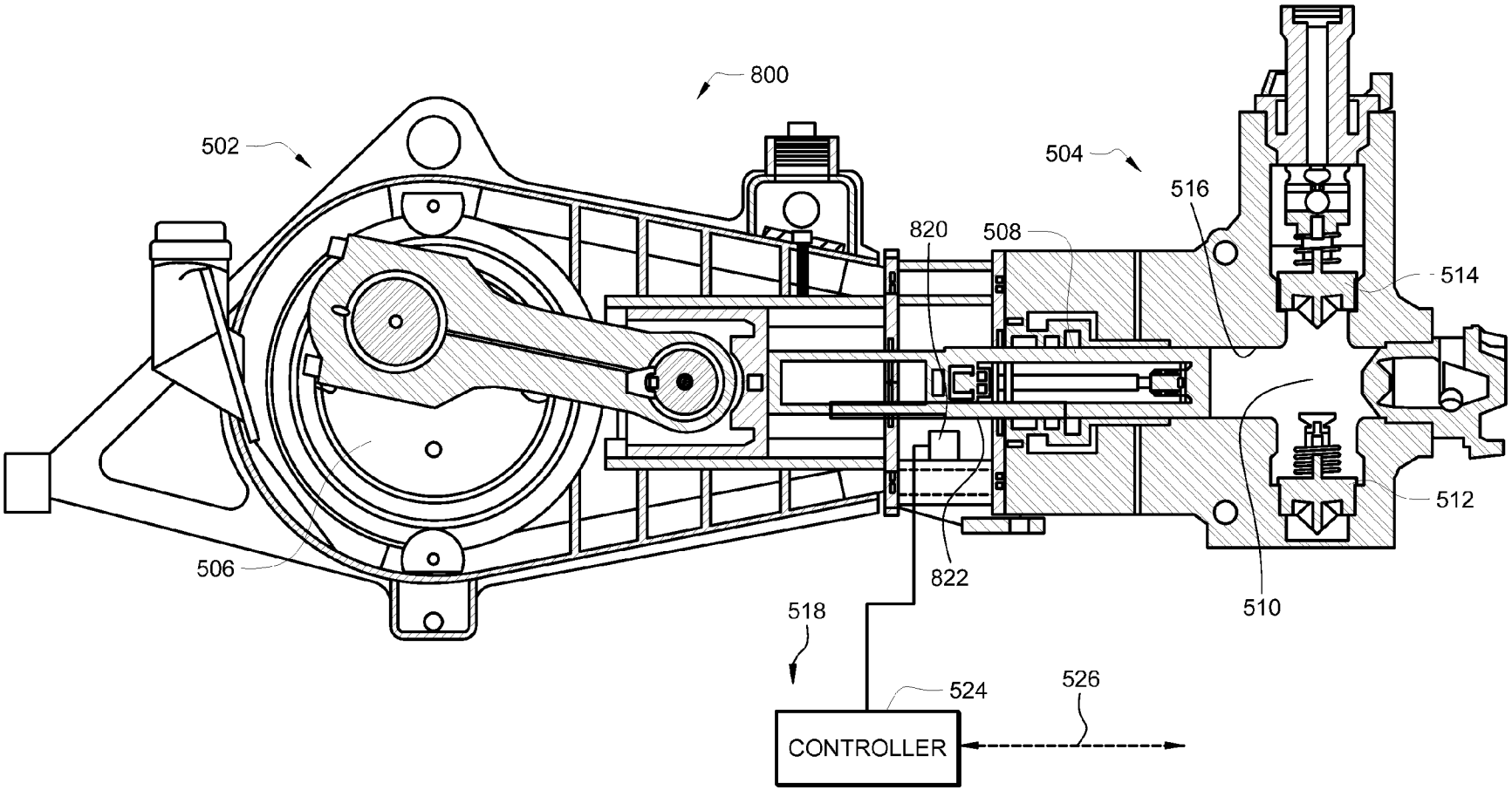
FIG. 10 is a cut-away view of a pump according to another embodiment.

Referring now to FIG. 10, another alternative embodiment of a pump 800 is shown. Pump 800 is substantially similar to pump 500, but instead of comprising a sensor 520 for sensing a crankshaft position, pump 800 comprises a plunger location sensor 820 for directly sensing the location of the plunger 508 within bore 516. In this embodiment, plunger location sensor 820 may be an optical sensor configured read, monitor, track, and/or register movement of optical markings 822 that are singly located or distributed along the length of the plunger. The sensed information from plunger location sensor 820 may be provided to pump controller 524 to allow a determination of plunger 508 location, speed, and/or direction within bore 516. Further, the sensed information may be provided to pump controller 524 and/or to main controller 140 as part of a feedback loop useful in controlling a speed, location, phase, and/or direction of plunger 508. It will be appreciated that in other embodiments, the plunger location sensor 820 may be otherwise configured to directly measure plunger 508 location. For example, the sensor plunger location sensor 820 may be configured as a magnetic sensor that responds to magnetic indicators on the plunger 508.

Figure 11:
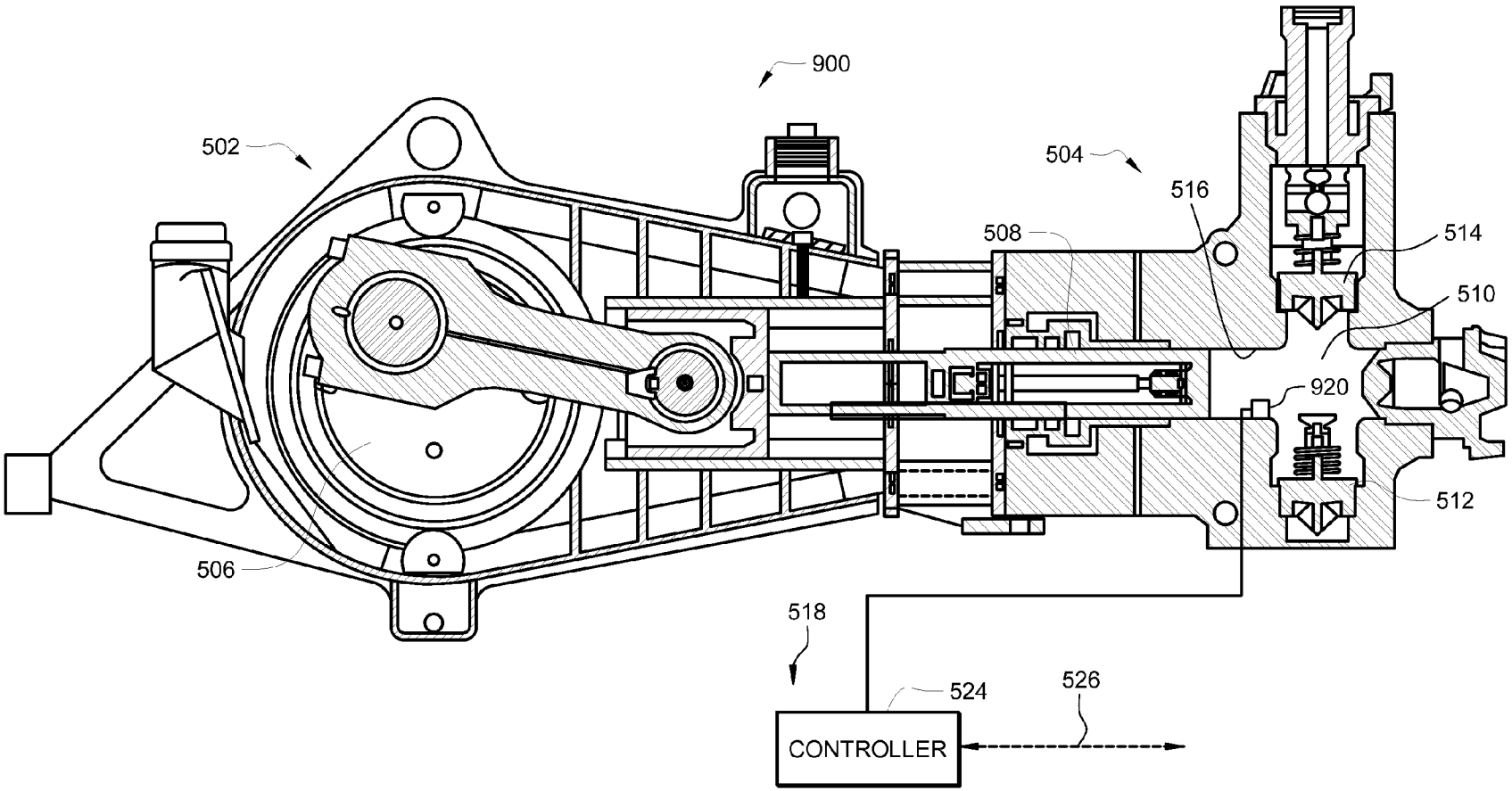
FIG. 11 is a cut-away view of a pump according to another embodiment.

Referring now to FIG. 11, another alternative embodiment of a pump 900 is shown. Pump 900 is substantially similar to pump 500, but instead of comprising a sensor 520 for sensing a crankshaft position, pump 900 comprises a pressure transducer 920 that measures a pressure within bore 516. In this embodiment, pressure transducer 920 may sense, monitor, track, and/or register a pressure within bore 516 and provide sensed information to pump controller 524. Based on the sensed pressure information, the pump controller 524 and/or the main controller 140 may calculate or otherwise determine, among other things, a location of the plunger 508, a speed of the plunger, and/or a direction of the plunger 508.

It will be appreciated that any of the above combinations of sensors, controllers, and/or pump control inputs may be configured to work together according to any number of feedback control system schemes. For example, the phase control systems 518 may be configured as a proportional-integral-derivative control system (PID controller), thereby allowing selective control over the speed, location, phase, and/or direction of plungers 508. It will further be appreciated that the control principles disclosed herein may be implemented to control, one or more plungers individually, one or more pumps 120 individually, one or more pump groups 121, or any combination thereof. Allowing such control provides complete control over all plunger speed, location, direction, and/or phase within a wellbore servicing system. Further, any combination of the disclosed pumps, sensors, controllers, and/or pump control inputs may be used to control a pump group according to an equal phase angle distribution and/or by controlling relative pulse phase between pressure pulses.

Further, it will be appreciated that while pumps 120 are disclosed as positive displacement pumps generally having fixed plunger 508 locations and/or phases relative to the crankshafts 506, alternative embodiments of pumps may comprise mechanical systems for adjusting plunger 508 position relative to a crankshaft 506. For example, systems may be incorporated that alter a stroke length of a plunger and/or allow controlled slippage in the linkages between the plunger 508 and the crankshaft 506. Such systems may be provided with sensors and/or other control inputs which further allow control over relative phase angles between various plungers, even where the plungers are within a single positive displacement pump and/or coupled to a common crankshaft. It will further be appreciated that alternative embodiments may comprise intensifier pumps or hydraulic drive pumps suitable for individually adjusting plunger phase angles. Still further, it will be appreciated that any of the above-described sensors, controllers, and/or pump control inputs may be used to control pump group performance of pump groups having pumps with different numbers of plungers.

It will be appreciated that the wellbore servicing systems and the methods disclosed herein can be used for any purpose. In an embodiment, the wellbore servicing systems and methods disclosed herein are used to service a wellbore that penetrates a subterranean formation by pumping a wellbore servicing fluid into the wellbore and/or subterranean formation. As used herein, a "servicing fluid" refers to a fluid used to drill, complete, work over, fracture, repair, or in any way prepare a well bore for the recovery of materials residing in a subterranean formation penetrated by the well bore. It is to be understood that "subterranean formation" encompasses both areas below exposed earth and areas below earth covered by water such as ocean or fresh water. Examples of servicing fluids include, but are not limited to, cement slurries, drilling fluids or muds, spacer fluids, fracturing fluids or completion fluids, and gravel pack fluids, all of which are well known in the art. Without limitation, servicing the well bore includes: positioning the wellbore servicing composition in the wellbore to isolate the subterranean formation from a portion of the wellbore; to support a conduit in the wellbore; to plug a void or crack in the conduit; to plug a void or crack in a cement sheath disposed in an annulus of the wellbore; to plug a perforation; to plug an opening between the cement sheath and the conduit; to prevent the loss of aqueous or nonaqueous drilling fluids into loss circulation zones such as a void, vugular zone, or fracture; to plug a well for abandonment purposes; to divert treatment fluids; and to seal an annulus between the wellbore and an expandable pipe or pipe string. In another embodiment, the wellbore servicing systems and methods may be employed in well completion operations such as primary and secondary cementing operation to isolate the subterranean formation from a different portion of the wellbore.

EXAMPLES

Example 1

Figure 3:
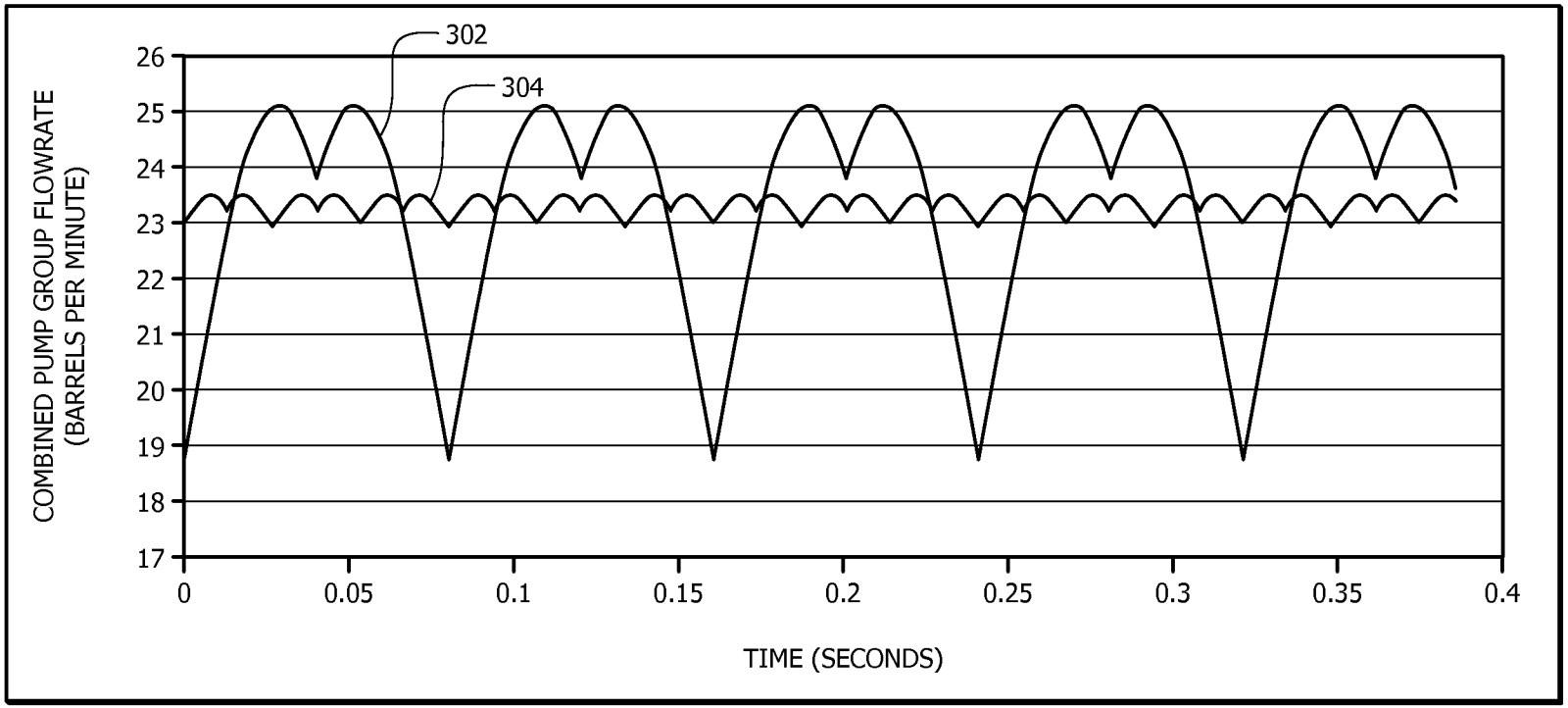
FIG. 3 is a plot of experimental test results of operation of a pump group according to another embodiment.

Referring now to FIG. 3, experimental test results from a pump group substantially similar to pump group 121 are shown. The pump group tested was operated according to a pumping profile different from the pumping profile 200. The pump group tested was operated according to a pumping profile having a performance plan that called for a combined pump flowrate of approximately 23 barrel per minute. In one test, the pump group was operated with all three pumps operating at substantially the same speed and with all three pumps being maintained in-phase. In other words, three groups (1 from each pump) of three plungers were in phase with each group 120 degrees from each other. The result of the testing with the three groups of three plungers substantially in-phase was recorded as the cyclical plot 302 having a peak to trough maximum deviation value of about 6.25 barrels per minute. The same plot 302 has a trough value of about 18.75 barrels per minute and a peak value of about 25 barrels per minute. Clearly, if a wellbore servicing job required substantially strict conformance to the desired combined pump flowrate of approximately 23 barrels per minute, such great variations in combined pump flowrate may be problematic and/or costly.

Still referring to FIG. 3, same pump group was again tested but under different operating conditions. In this other test, the pump group was operated with the three pumps operating at substantially the same speed and/or flowrate, but with the nine plungers equally phase shifted by 40 degrees as described above with respect to wellbore servicing system 100. The result of the testing with the nine plungers that are substantially equally phase-shifted by 40 degrees was recorded as the cyclical plot 304 having a peak to trough maximum deviation value of about 0.5 barrels per minute. The same plot 304 has a trough value of about 23 barrels per minute and a peak value of about 23.5 barrels per minute. Clearly, if a wellbore servicing job requires substantially strict conformance to the desired combined pump flowrate of approximately 23 barrels per minute, operating the pump group in the equally phase-shifted manner described above provides less variation from the target combined flowrate of 23 barrels per minute than the above-described in-phase operation of the same pump group. This operation of the pump group with substantially equal phase-shifting among the nine plungers provides an improved system and method for closely conforming to a desired combined pump flowrate and other combined pump effect operational characteristics.

The plot 304 demonstrates that this embodiment can conform to a desired performance plan (e.g., a desired combined pump flowrate of 23 barrels per minute) within only about 2-3%, alternatively about 2.1%, or alternatively about 2.17% transient variation from the desired performance plan value. The plot 302 shows about a 28% transient variation from the desired performance plan. Accordingly, this embodiment demonstrates that a transient variation from a desired performance plan may be reduced by about 80-90%, alternatively by about 90%, alternatively by about 92%, or alternatively by about 92.2%, or alternatively by about 92.25% simply by operating the system out of phase in the manner described rather than in-phase. Accordingly, this example shows that by altering a pumping parameter (in this case a phase angle of a plunger) a resultant phase sensitive combined pump effect operational characteristic (in this case a combined pump group flowrate) can be caused to conform more closely to a pumping profile.

Example 2

Figure 4:
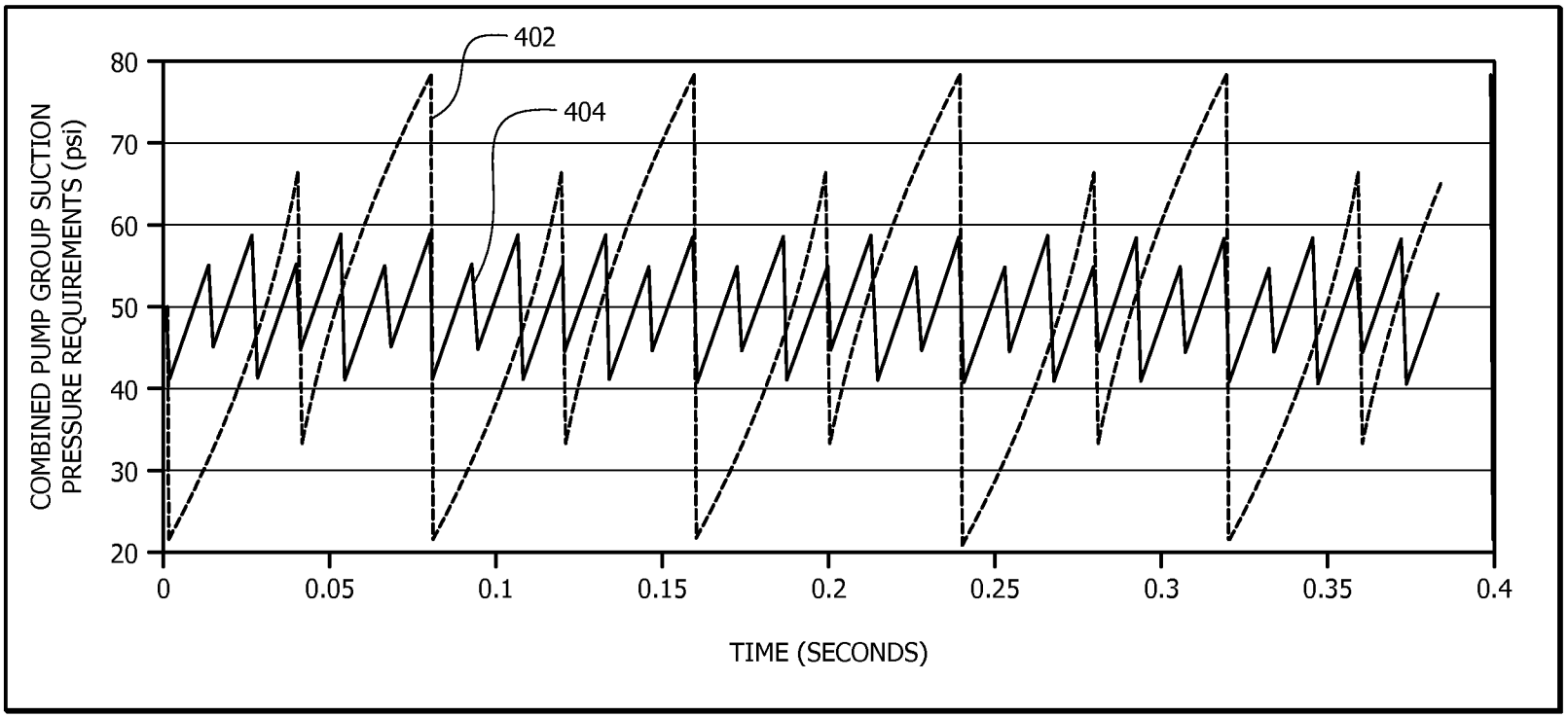
FIG. 4 is another plot of experimental test results of operation of the pump group of FIG. 3.

Referring now to FIG. 4, a pump group substantially the same as the pump group of FIG. 3 was operated in substantially the same two different manners described above, one test with the nine plungers in-phase (i.e., plot 402) and one test with the nine plungers that are substantially equally phase-shifted by 40 degrees (i.e., plot 404). The results of the two tests again show that operation of the plungers substantially equally phase-shifted by 40 degrees results in a lower maximum deviation value of a combined pump effect operational characteristic. In the graph of FIG. 4, a pressure loss measured over the length of a ten foot hose on the suction input side of the pump is shown. It will be appreciated that the pump group was operated according to a pumping profile that provided 50 psi pressure to the inlet of the pumps. The result of the testing with the nine plungers substantially in-phase was recorded as the cyclical plot 402 having a peak to trough maximum deviation value of about 60 psi. The same plot 402 has a trough value of about 20 psi and a peak value of about 80 psi. Clearly, if a wellbore servicing job requires substantially strict conformance to the desired inlet pressure to the pumps, such great variations in the actual pressure loss over the ten foot hose may be problematic and/or costly. The present disclosure provides an improved system and method for closely conforming to such desired pressure and other combined pump effect operational characteristics.

Still referring to FIG. 4, the same pump group was operated with the three pumps operating at substantially the same but with the nine plungers equally phase shifted by 40 degrees as described above with respect to wellbore servicing system 100. The result of the testing with the nine plungers substantially equally phase-shifted by 40 degrees was recorded as the cyclical plot 404 having a peak to trough maximum deviation value of about 20 psi. The same plot 404 has a trough value of about 40 psi and a peak value of about 60 psi. Clearly, if a wellbore servicing job requires substantially strict conformance to the desired pump inlet pressure of 50 psi, operating the pump group in the equally phase-shifted manner described above provides less variation from the target pressure of 50 psi than the above-described in-phase operation of the same pump group. This operation of the pump group with substantially equal phase-shifting among the nine plungers provides an improved system and method for closely conforming to a desired pump inlet pressure operational characteristic.

The plot 404 demonstrates that this embodiment can conform to a desired performance plan (e.g., a desired pump inlet pressure of 50 psi) within only about 30-50% or alternatively about 40% transient variation from the desired performance plan value. The plot 402 shows about a 120% transient variation from the desired performance plan. Accordingly, this embodiment demonstrates that a transient variation from a desired performance plan may be reduced by about 60-70%, alternatively by about 66%, or alternatively by about 66.6% simply by operating the system out of phase in the manner described rather than in-phase. Accordingly, this example shows that by altering a pumping parameter (in this case a phase angle of a plunger) a resultant phase sensitive combined pump effect operational characteristic (in this case a combined pump group inlet pressure) can be caused to conform more closely to a pumping profile.

Further, the higher rate of change illustrated by plots 302 and 402 indicate that higher boost pump pressure requirement at a blender of a wellbore servicing system may be required to prevent the pumps from cavitating as compared to a lower boost pump pressure requirement when the pumps are operated in-phase as represented by plots 304 and 404. It will be appreciated that this difference in boost pump pressure requirement is ruled by the associated pressure drop over the hoses connected to the suction which can be expressed as $$\text{pressure_drop} = \frac{dQ}{dt} * \frac{\rho L}{A}$$

where $\frac{dQ}{dt}$ = rate_of_change_of_flowrate,

-continued $\rho$ = density_of_fluid, $L$ = length_of_hose, and $A$ = cross – sectional_area_of_hose.

This relationship clearly indicates that an increase in the rate of change of flowrate results in an increase in pressure drop over the length of the suction hose.

Example 3

Figure 6:
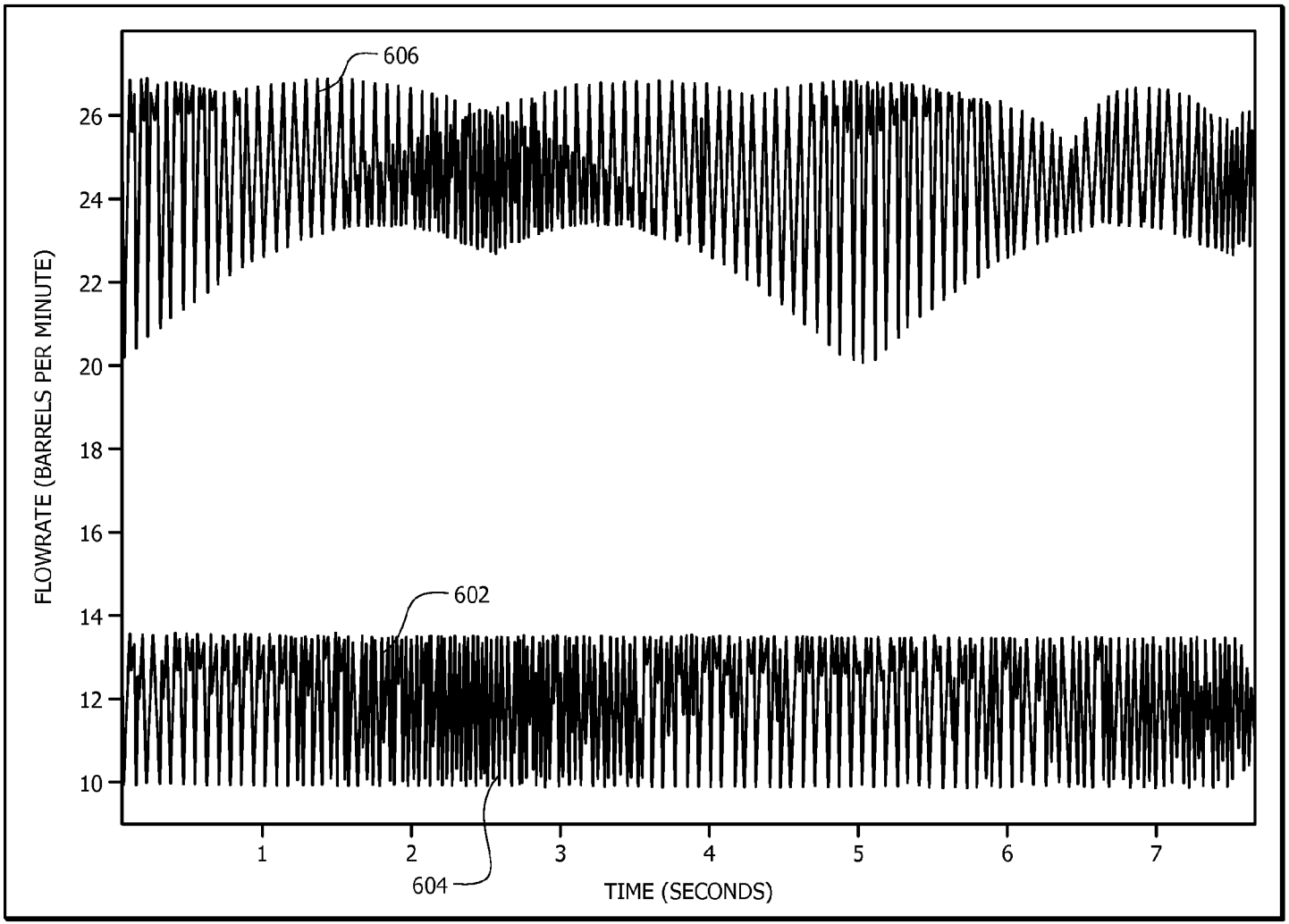
FIG. 6 is a plot showing operation of two pumps at slightly different speeds.

Referring now to FIG. 6, it will be appreciated that operating two or more pumps at substantially the same speed, but not precisely the same speed, can negatively impact a combined pump effect operational characteristic. For example, a first pump of FIG. 6 was operated 189 rpm while a second pump of FIG. 6 was operated at 187 rpm. The first pump and the second pump are substantially similar to pumps 120 and are configured to have 2 groups (1 from each pump) of three plungers in-phase with each group 120 degrees from each other. The first pump is represented by plot 602, the second pump is represented by plot 604, and the combined pump flow rate is represented by plot 606.

At the beginning of operation of the first and second pumps, the pumps were substantially in-phase with each other. This in phase operation resulted in an initial transient flowrate variation of about 6.5 barrels per minute at about second 0. However, considering that the plungers of the different pumps are traveling through their strokes at different rates, the phase difference between the first pump plungers and the second pump plungers gradually changes until after about 2.5 seconds of operation, the plungers of the two pumps are substantially out of phase with each other by about 180 degrees. This out of phase operation results in a reduced transient flowrate variation of about 3 barrels per minute at about second 2.5. Between about second 2.5 and about second 5, the phase difference between the first pump plungers and the second pump plungers gradually changes until the first pump plungers and the second pump plungers are substantially in-phase, again resulting in the larger 6.5 barrels per minute transient flowrate variation. This example demonstrates that when conformance to a performance plan requires that flowrate variations be minimized, it is clear that time spent operating the two pumps in the in-phase arrangement is less beneficial due to larger variations in flowrate. Accordingly, this example shows that a pumping parameter (in this case a speed of a pump) can affect a resultant phase sensitive combined pump effect operational characteristic (in this case a combined pump group flowrate).

Example 4

Figure 7:
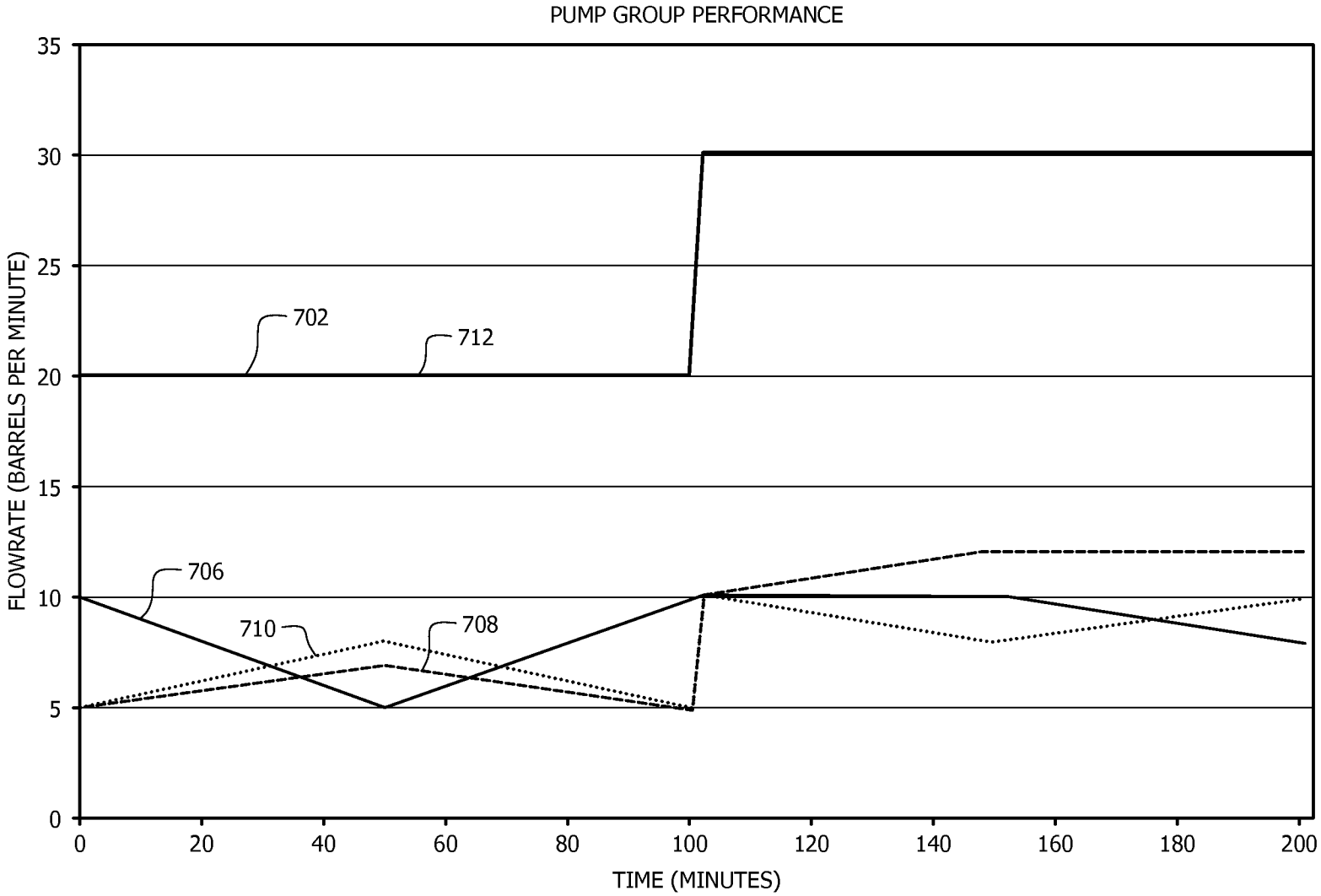
FIG. 7 is a plot showing hypothetical operation of a pump group according to another embodiment.

Referring now to FIG. 7, a combined pump group flowrate (which is a combined pump effect operational characteristic) for a hypothetical wellbore servicing system is shown as closely conforming to a performance plan 702 of a pumping profile that is substantially similar to the performance plan of pumping profile 200. Specifically, the performance plan 702 requires delivery of wellbore servicing fluids downhole at a rate of about 20 barrels per minute for about the first 100 minutes of operation. After the first 100 minutes of operation, the flowrate of fluid delivery downhole is increased over approximately 2 minutes to a new desired combined flowrate of approximately 30 barrels per minute. After reaching the flowrate of approximately 30 barrels per minute, performance plan 702 requires delivery of wellbore servicing fluids at about 30 barrels per minute until about minute 200 of operation. However, unlike pump group 121, the pumps of a pump group 704 operate at substantially different flowrates, and in this case, at substantially different speeds (the pump speed to flowrate relationship is assumed to be substantially linear).

At the start of operation, a first pump 706, a second pump 708, and a third pump 710 operate at about 10, 5, and 5 barrels per minute, respectively, totaling the required 20 barrels per minute required by the performance plan 702. However, unlike the previously discussed embodiments, the flowrate and/or speed of the first, second, and third pumps 706, 708, 710 are operated with substantially constantly changing flowrates and/or speeds. In this embodiment, during about the first 50 minute of operation, the first, second, and third pumps 706, 708, 710 gradually change flowrate and/or speed until they operate at about 5, 7, and 8 barrels per minute, respectively. In this embodiment, the pumps 706, 708, 710 reach the new operating flowrates and/or speeds through linear progressions and substantially maintain the required 20 barrels per minute of the performance plan 702. From about minute 50 of operation to about minute 100 of operation, the first, second, and third pumps 706, 708, 710 gradually change flowrate and/or speed until they operate at about 10, 5, and 5 barrels per minute, respectively. Next, from about minute 100 to about minute 110 of operation, the first, second, and third pumps 706, 708, 710 gradually change flowrate and/or speed until they operate at about 10, 10, and 10 barrels per minute, respectively, thereby meeting the 30 barrels per minute flowrate required by the performance plan 702.

It will be appreciated that the pumps 706, 708, 710 even conformed to providing the sharply increasing flowrate required by performance plan 702 between about minutes 100 and 110 of operation. From about minute 110 to about minute 150 of operation, the second and third pumps 708, 710 gradually change flowrate and/or speed until they operated at about 12 and 8 barrels per minute, respectively, while the flowrate and/or speed of the first pump remained at about 10 barrels per minute. Finally, from about minute 150 to about minute 200 of operation, the first, second, and third pumps 706, 708, 710 gradually changed flowrate and/or speed until they operate at about 8, 12, and 10 barrels per minute, respectively, and then cease operation. While operating the first, second, and third pumps 706, 708, 710 may induce some decreased conformance to the performance plan 702 for a combined pump effect operational characteristic, i.e., the combined flowrate 712 of pumps 706, 708, 710, cyclical occurrences shown in FIG. 6 will be minimized.

While pumps 706, 708, 710 may be operated according to a pumping profile having a performance plan such as performance plan 702, other methods of operating the pumps 706, 708, 710 may be used in alternative embodiments. For example, in one alternative embodiment, pumps 706, 708, 710 may be operated, managed, and/or controlled by a linear or non-linear controller that uses logical parameters to maintain the flowrate, speed, and/or other control of the pumps 706, 708, 710 so that undesirably high non-conformance to a pumping profile is avoided. For example, a controller may be programmed to control the pumps 706, 708, 710 so that if an undesirable degree of variation from a pumping profile occurs, the flowrates and/or speeds of the pumps 706, 708, 710 are either immediately set to new values and/or are set to operate according to a new rate of change of flowrate.

In another alternative embodiment, pumps 706, 708, 710 may be periodically and/or randomly set to new values and/or set to operate according to a new rate of change of flowrate. In this embodiment, the controller does not wait to sense feedback that induces a change in pump operation, but rather, is programmed to change pump operation according to randomly generated value for at least one of the three pump flowrates. Of course, where one or more pump flowrates and/or speeds is randomly determined (within a range of achievable values), at least the last remaining undefined pump flowrate and/or speed will be restricted to those values that allow the combined total flowrate and/or speed to conform to a performance plan of a pumping profile. While operating the first, second, and third pumps 706, 708, 710 in this manner may induce some decreased conformance to a performance plan for a combined pump effect operational characteristic, i.e., the combined flowrate of pumps 706, 708, 710, the cyclical occurrences shown in FIG. 6 will be minimized. Accordingly, this example shows that a pumping parameter (in this case, speed of a pump) can be controlled to operate a wellbore servicing system in conformance with a pumping profile which may result in a reduced amount of in-phase operation.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural or other details supplementary to the disclosure.

What is claimed is:

1. A method of servicing a wellbore, comprising:

providing fluid communication between a first pump and the wellbore;

providing fluid communication between a second pump and the wellbore;

establishing a pumping profile having a performance plan; and delivering a wellbore servicing fluid into the wellbore, wherein delivering the wellbore servicing fluid into the wellbore comprises:

operating the first pump according to a first pumping parameter value; and operating the second pump according to the second pumping parameter value;

wherein the second pumping parameter value is selected relative to the first pumping parameter value to improve a conformance of a phase sensitive combined pump effect operational characteristic to the performance plan.

2. The method of claim 1, wherein the first pump is operated to provide substantially the same fluid flow output as the fluid flow output of the second pump.

3. The method of claim 2, wherein the first pumping parameter is a phase angle of a plunger of the first pump and the second pumping parameter is a phase angle of a plunger of the second pump.

4. The method of claim 3, wherein the first pumping parameter value is substantially out of phase with the second pumping parameter value.

5. The method of claim 3, wherein the first pumping parameter value and the second pumping parameter value are substantially selected according to an equal phase angle distribution arrangement.

6. The method of claim 1, wherein each pump comprises at least one plunger and wherein the plungers are arranged according to an equal phase angle distribution arrangement.

7. The method of claim 1, wherein the first pumping parameter is an output flowrate of the first pump and the second pumping parameter is an output flowrate of the second pump.

8. The method of claim 7, wherein the performance plan of the pumping profile requires that a combined pump group flowrate, that comprises the output flowrate of the first pump and the output flowrate of the second pump, changes over a period of time.

9. The method of claim 8, wherein the change over a period of time is a substantially linear change.

10. The method of claim 7, wherein at least one of the first pumping parameter value and the second pumping parameter value changes over a period of time.

11. The method of claim 10, wherein the change over a period of time is a substantially linear change.

12. The method of claim 1, wherein the phase sensitive combined pump effect operational characteristic is a combined pump group flowrate.

13. The method of claim 1, wherein the phase sensitive combined pump effect operational characteristic is a combined pump group pressure.

14. The method of claim 1, wherein the phase sensitive combined pump effect operational characteristic is a characteristic of one of the first pump and the second pump.

15. The method of claim 1, wherein the first pump and second pump belong to a pump group comprising a plurality of plungers; and wherein at least some of the plurality of plungers are substantially configured according to an equal phase angle distribution arrangement.

16. The method according to claim 15, further comprising:

at least one phase control system for managing a phase of at least one of the plurality of plungers.

17. The method according to claim 16, wherein the at least one phase control system comprises a sensor for monitoring a position of the at least one of the plurality of plungers.

18. The method according to claim 16, wherein the at least one phase control system manages the phase of the at least one of the plurality of plungers in response to a phase sensitive combined pump effect operational characteristic value.

19. The method according to claim 18, wherein the phase sensitive combined pump effect operation characteristic is a combined pump group pressure.

20. The method according to claim 18, wherein the phase sensitive combined pump effect operation characteristic is a combined pump group flowrate.

21. The method of claim 1, wherein the first pump and second pump belong to a pump group comprising a plurality of pumps, wherein the sum of the flowrates of the plurality of pumps is substantially equal to a combined pump group flowrate; and wherein at least one pumping parameter of the at least one of the plurality of pumps is variable to improve a conformance of a phase sensitive combined pump effect operational characteristic to a pumping profile.

22. The method according to claim 21, wherein the at least one pumping parameter is randomly altered.

23. The method according to claim 21, wherein the at least one pumping parameter is altered according to linear or nonlinear control parameters.

24. The method according to claim 21, wherein the at least one pumping parameter is varied to prevent a cyclical recurrence in increased nonconformance of the phase sensitive combined pump effect operational characteristic to the pumping profile.

25. A method of servicing a wellbore, comprising:

providing fluid communication between a first pump and the wellbore;

providing fluid communication between a second pump and the wellbore;

establishing a pumping profile having a performance plan; and delivering a wellbore servicing fluid into the wellbore, wherein delivering the wellbore servicing fluid into the wellbore comprises:

operating a first pump to provide pressure pulses according to a first frequency;

operating a second pump to provide pressure pulses according to a multiple of the first frequency; and controlling a relative pressure pulse phase between a first pressure pulse provided by the first pump and a second pressure pulse provided by the second pump to improve a conformance of a phase sensitive combined pump effect operational characteristic to the performance plan.

26. The method of claim 25, wherein the relative pressure pulse phase is controlled to prevent simultaneous occurrence of the first pressure pulse and the second pressure pulse.

27. The method of claim 25, further comprising a third pressure pulse provided by the first pump, the second pressure pulse occurring between the first pressure pulse and the third pressure pulse.

28. The method of claim 25, further comprising a third pressure pulse provided by the first pump, wherein the time period between the occurrence of the first pressure pulse and the second pressure pulse is substantially equal to the time period between the occurrence of the second pressure pulse and the third pressure pulse.

29. The method of claim 25, further comprising operating a third pump to provide pressure pulses according to a multiple of the first frequency wherein the second pressure pulse occurs between the first pressure pulse and a third pressure pulse provided by the third pump.

30. The method of claim 29, wherein the time period between the occurrence of the first pressure pulse and the second pressure pulse is substantially equal to the time period between the occurrence of the second pressure pulse and the third pressure pulse.

* * * * *